US008163455B2

(12) United States Patent
Watanabe et al.

(10) Patent No.: US 8,163,455 B2
(45) Date of Patent: Apr. 24, 2012

(54) TONER FOR IMAGE FORMATION, METHOD FOR PRODUCING TONER, CONTAINER CONTAINING TONER, TWO-COMPONENT DEVELOPER, PROCESS CARTRIDGE, AND IMAGE FORMING METHOD

(75) Inventors: Naohiro Watanabe, Shizuoka (JP); Hiroshi Yamashita, Numazu (JP); Shinichi Wakamatsu, Numazu (JP); Tsuyoshi Sugimoto, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 472 days.

(21) Appl. No.: 12/403,569

(22) Filed: Mar. 13, 2009

(65) Prior Publication Data

US 2009/0233204 A1 Sep. 17, 2009

(30) Foreign Application Priority Data

Mar. 14, 2008 (JP) ..... 2008-065799

(51) Int. Cl.
*G03G 9/00* (2006.01)

(52) U.S. Cl. ..... 430/109.4; 430/108.1; 430/108.4; 430/109.1

(58) Field of Classification Search ..... 430/108.1, 430/108.22, 108.4, 109.1, 109.4, 137.17
See application file for complete search history.

(56) References Cited

U.S. PATENT DOCUMENTS

| | | | | |
|---|---|---|---|---|
| 7,217,487 | B2 | 5/2007 | Nanya et al. | |
| 7,294,442 | B2 | 11/2007 | Takada et al. | |
| 7,348,121 | B2 | 3/2008 | Inoue et al. | |
| 7,396,630 | B2 | 7/2008 | Watanabe et al. | |
| 7,419,756 | B2 | 9/2008 | Yamashita et al. | |
| 2002/0102485 | A1 * | 8/2002 | Abe et al. | 430/108.22 |
| 2003/0096185 | A1 | 5/2003 | Yamashita et al. | |
| 2006/0210903 | A1 * | 9/2006 | Ohki et al. | 430/109.4 |
| 2006/0240349 | A1 | 10/2006 | Watanabe et al. | |
| 2007/0218392 | A1 | 9/2007 | Yamada et al. | |
| 2007/0275315 | A1 | 11/2007 | Nagatomo et al. | |
| 2008/0032226 | A1 | 2/2008 | Sugiyama et al. | |
| 2008/0069606 | A1 | 3/2008 | Yamashita et al. | |
| 2008/0070144 | A1 | 3/2008 | Nagatomo et al. | |
| 2008/0070151 | A1 | 3/2008 | Sugimoto et al. | |
| 2008/0090165 | A1 | 4/2008 | Yamada et al. | |
| 2008/0227002 | A1 | 9/2008 | Moriya et al. | |
| 2008/0233496 | A1 | 9/2008 | Kotsugai et al. | |
| 2008/0280218 | A1 | 11/2008 | Sabu et al. | |
| 2008/0280219 | A1 | 11/2008 | Nakayama et al. | |

(Continued)

FOREIGN PATENT DOCUMENTS

| | | |
|---|---|---|
| JP | 5-40908 | 2/1993 |

(Continued)

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

Provided is a toner for image formation, granulated by dispersing, emulsifying, or both dispersing and emulsifying an oil phase containing toner constituting materials in an aqueous medium. The toner constituting materials contain a binder resin, a colorant and a pigment dispersant which is a polyester derivative having an acid value of 28 to 50 mgKOH/g and an amine value of 1 to 50 mgKOH/g, and satisfy the following Expressions 1 and 2, where Expression 1 represents a mass ratio, $\alpha$ is a glass transition temperature of the binder resin, and $\beta$ is a glass transition temperature of a mixture of the binder resin and the pigment dispersant in the ratio of Expression 1.

Binder resin:Pigment dispersant=100:5 Expression 1

$0° C. \leqq \alpha - \beta \leqq 10° C.$ Expression 2

8 Claims, 2 Drawing Sheets

U.S. PATENT DOCUMENTS

| | | | |
|---|---|---|---|
| 2008/0318144 | A1 | 12/2008 | Watanabe et al. |
| 2008/0318148 | A1 | 12/2008 | Sugimoto et al. |

FOREIGN PATENT DOCUMENTS

| | | |
|---|---|---|
| JP | 2537503 | 7/1996 |
| JP | 3127601 | 11/2000 |
| JP | 2001-66827 | 3/2001 |
| JP | 2001-89682 | 4/2001 |
| JP | 2002-311645 | 10/2002 |
| JP | 2003-270863 | 9/2003 |
| JP | 2004-20908 | 1/2004 |
| JP | 2004-70089 | 3/2004 |
| JP | 2004-163805 | 6/2004 |
| JP | 3661422 | 4/2005 |

* cited by examiner

TONER FOR IMAGE FORMATION, METHOD FOR PRODUCING TONER, CONTAINER CONTAINING TONER, TWO-COMPONENT DEVELOPER, PROCESS CARTRIDGE, AND IMAGE FORMING METHOD

BACKGROUND OF THE INVENTION

1. Field of the Invention

The present invention relates to a toner for image formation, a method for producing a toner for image formation, a toner container, a two-component developer, a process cartridge, and an image forming method.

2. Description of the Related Art

In electrophotographic image forming apparatus, electrostatic recording apparatus, etc., electric or magnetic latent images are visualized by a toner. In electrophotography, for example, a toner image is produced by forming an electrostatic image (latent image) on a photoconductor and developing the image by a toner. The toner image is generally transferred onto a transfer material (e.g., paper) and fixed thereon by heating or the like. The toner used for development of latent electrostatic images is generally composed of colored particles prepared by adding a colorant, a charge control agent and additional additives in a binder resin. The toner production methods are broadly classified into pulverization methods and suspension polymerization methods. In the pulverization method, a colorant, a charge control agent, an offset inhibitor and other agents are melt-kneaded with a thermoplastic resin and uniformly dispersed therein, and the resultant composition is pulverized and classified to produce a toner.

The pulverization method can produce a toner with excellent characteristics at a certain degree, but the latitude is limited in the selection of toner materials. For example, the toner composition prepared by melt-kneading of toner materials needs to be capable of being pulverized and classified with devices which can be operated economically. This requirement necessitates that the melt-kneaded composition be sufficiently fragile. For this reason, when the toner composition is pulverized into particles, it becomes likely that a broad particle size distribution is produced, and therefore, in an attempt to produce a high-resolution copy image with many levels of gray, it is necessary to remove, for example, fine particles with a diameter of 5 μm or less, particularly 3 μm or less, and coarse particles with a diameter of 20 μm or more by classification. This leads to very low toner yield. By the pulverization method, it is difficult to uniformly disperse such agents as a colorant and a charge control agent in thermoplastic resin. Moreover, by the pulverization method, the colorant component added in the toner is undesirably exposed to the toner surface and thereby the charge distribution becomes uneven over the toner surface, leading to a broader toner charge distribution and poor developing characteristics. Thus, the current situation is that kneading/pulverization methods cannot fully satisfy the requirements of producing high-performance toner owing to these problems.

In recent years, toner production methods using suspension polymerization have been suggested and put into practice as methods that can overcome the above-mentioned problems pertinent in pulverization methods. Production of a toner for developing a latent electrostatic image by polymerization is a conventionally known technology; for example, current toner particles are produced by suspension polymerization. Toner particles produced by suspension polymerization, however, have substantially spherical shape and thus are hard to be removed. In the case of low-image coverage development and transferring, the amount of residual toner particles is small and thus cleaning failure is not significant. However, cleaning failure becomes significant in the case of development and transferring of a high image coverage object, such as a picture image. Moreover, toner particles that have been used for development but remained untransferred due to paper feed failure or the like reside on the photoconductor as residual toner particles and cause background smear when accumulated.

Such residual toner particles smear on, for example, a charging roller, which is brought into contact with and charges the photoconductor, preventing it from exerting its original charging ability. Moreover, since the toner is produced at the same time when a resin is produced by suspension polymerization, it is often the case that toner materials used for conventionally known toners cannot be used in suspension polymerization. Even when polymerization is successfully effected using conventionally known materials, in some cases, the particle size cannot be fully controlled due to influences of resin and additives such as colorant. Thus, one of the problems associated with suspension polymerization is its limited latitude in the selection of materials, with the major problem being the fact that polyester resins, which offer excellent toner fixing property and coloring property when employed in conventionally known kneading/pulverization methods, cannot be generally employed and, therefore, this method cannot be used in view of growing demands for smaller, faster color printers. To overcome the problem pertinent in suspension polymerization, for example, Japanese Patent (JP-B) No. 2537503 discloses a method of producing randomly shaped toner particles by aggregating fine resin particles produced by emulsion polymerization.

In the toner particles produced by emulsion polymerization, however, a large number of surfactant components remain not only on the toner surface, but inside the toner even after washing process, leading to poor toner charge stability and broader charge amount distribution, which in turn causes background smears on the obtained image. In addition, the remained surfactant smears on the photoconductor, a charging roller, a developing roller, and other members, preventing them from exerting their original charging ability. Even in the case of emulsion polymerization where the colorant components are hardly exposed to the toner surface, it is difficult to uniformly disperse the colorant in the toner since the colorant components are easily aggregated together. Because the manner in which colorant exists differs between individual toner particles, there are variations in charge amount among toner particles and thus toner stability over a long period decreases. In addition, in the case of color printing, slight reductions in developing ability and transfer ability leads to poor color balance and poor gray scale. Furthermore, since the colorant in the toner particles is generally hydrophilic and is not compatible with resin, diffused reflection of transmitted light occurs at the interface of surfactant and resin components, reducing the transparency of OHP sheets and the like when printed. Namely, when the colorant is not sufficiently dispersed in the toner, the transparency of the printed OHP sheet reduces.

Japanese Patent Application Laid-Open (JP-A) No. 2001-66827 discloses a toner produced by the method including the steps of dissolving or dispersing in a first organic solvent capable of dissolving a binder resin, a pigment dispersant and a pigment that has been surface-treated with a fatty acid, so as to prepare a pigment dispersion solution, of mixing a binder resin with the pigment dispersion solution in a second organic solvent capable of dissolving binder resin, so as to prepare an oil component, of suspending the oil component in an aqueous medium to form microdroplets of the oil component, and of removing the solvent from the suspension. However, fatty acids contain no amino groups that control toner charging ability.

JP-B No. 3661422 discloses a toner produced by using a polymer dispersant as a pigment dispersant. This disclosure specifies the acid value and amine value of the polymer dispersant so as to provide a toner that offers excellent offset resistance, charging ability, storage stability, color developing ability, and OHP transparency. However, storage stability, particularly resistance to "blocking" that occurs during toner delivery, are insufficient. In this disclosure, a synergist, or a pigment derivative, is added as a pigment dispersant. This synergist can enhance pigment dispersibility by introducing polar groups into the pigment so as to increase its interactions with the pigment dispersant. However, when the synergist is used in the production of so-called chemical toner, where toner is prepared in an aqueous system, it results in unwanted migration of pigment components toward toner surface or into the aqueous phase during toner production. The causes of these phenomena still remain elusive. In general, synergists are considered to adsorb to surfaces of pigment components, where they introduce polar groups into the pigment so as to increase its interactions with a pigment dispersant. The polar groups of synergists are considered to be generally hydrophilic, suggesting that migration of pigment component toward toner surface or into the aqueous phase occurs during toner production. These phenomena lead to reduced coloring ability and reduced color saturation, and/or poor fixing characteristics, and furthermore, leads to pigment smear on other members.

BRIEF SUMMARY OF THE INVENTION

Therefore, excessive compatibility of the pigment dispersant (polymer type pigment dispersant) with the binder resin poses a problem that the binder resin develops plasticity resulting in deteriorated storage stability and other properties of the toner. Further, an oilless toner, which eliminates the need to provide an oil feeder for the fixing device and contains a releasing agent added therein instead of oil, is becoming standard particularly in color image forming apparatuses.

Accordingly, a toner for image formation, which can satisfy the requirement for toner storage stability and can realize granulation in an aqueous medium with sufficient fixing properties, has not yet been provided.

In view of the above problems of the related art, the present invention has been made, and an object of the present invention is to avoid a deterioration in storage stability by adjusting a difference of Tg between a binder resin and a mixture of a binder resin and a pigment dispersant within a specific range, and to provide a toner for image formation excellent in storage stability which has been problematic when a pigment dispersant is used, and having excellent offset resistance and charging ability, good color development characteristics and OHP transparency.

Means for solving the above-described problems are as follows.

The toner for image formation of the present invention is granulated by dispersing, emulsifying, or both dispersing and emulsifying an oil phase containing toner constituting materials in an aqueous medium, in which the toner constituting materials contain: a binder resin; a colorant; and a pigment dispersant which is a polyester derivative having an acid value ranging from 28 mgKOH/g to 50 mgKOH/g, and an amine value ranging from 1 mgKOH/g to 50 mgKOH/g, and moreover the toner constituting materials satisfy the following Expressions 1 and 2:

$$\text{Binder resin:Pigment dispersant}=100:5 \qquad \text{Expression 1}$$

$$0^\circ\ \text{C.} \leqq \alpha-\beta \leqq 10^\circ\ \text{C.} \qquad \text{Expression 2}$$

where Expression 1 represents a mass ratio, $\alpha$ is a glass transition temperature of the binder resin, and $\beta$ is a glass transition temperature of a mixture of the binder resin and the pigment dispersant in the ratio of Expression 1.

In the toner of the present invention, the glass transition temperature of the binder resin ranges from 40° C. to 65° C.

In the toner of the present invention, a melting point of the pigment dispersant ranges from 20° C. to 80° C.

In the toner of the present invention, the pigment dispersant is contained in the toner in a ratio ranging 0.1% by mass to 5% by mass.

In the toner of the present invention, the oil phase contains a precursor of the binder resin (hereinafter, simply referred as "precursor") included in the toner constituting materials.

In the toner of the present invention, the toner has a ratio Dv/Dn of a volume average particle size Dv thereof to a number average particle size Dn thereof ranging from 1.00 to 1.25.

The method for producing a toner for image formation of the present invention is a method for producing the above-mentioned toner, and in the method, the oil phase contains a solvent in which the toner constituting materials are dissolved or dispersed.

In the method of the present invention above, the solvent contains an organic solvent, and the method further contains removing the organic solvent.

The method for producing a toner for image formation of the present invention is a method for producing the above-mentioned toner, and in the method, the aqueous medium comprises a polymer dispersant.

In the method of the present invention above, the polymer dispersant is a water-soluble polymer.

The toner container of the present invention contains the toner for image formation, and a container housing the toner therein.

The two-component developer of the present invention contains the toner for image formation, and a carrier.

The process cartridge of the present invention contains a developing unit containing the two-component developer, and an image carrier.

The image forming method of the present invention contains forming an image using the two-component developer.

As will be understood by the following detailed and specific description, dispersion characteristics of a colorant have been improved in a toner of the present invention by adjusting the acid value and the amine value of a pigment dispersant within a specific range, and the color development characteristics and the OHP optical transparency of the toner have been improved, and besides dispersion stability of a colorant in the colorant dispersion liquid is excellent, storage stability of the colorant dispersion liquid has been enhanced and efficiency of particle production has been increased, and besides deterioration in charging ability, which is a problem associated with the use of a pigment dispersant, can be averted. Furthermore, selectable range of a resin and a colorant can be extended by adjusting the glass transition temperature of a mixture of a pigment dispersant and a binder resin and the glass transition temperature of the binder resin within specific ranges and by adjusting the melting point of the pigment dispersant within a specific range. Besides, collapse of the pigment dispersion system can be prevented by adding other additives such as wax and at the same time there can be exhibited an extremely excellent effect that colorant fine particles are uniformly dispersed in a toner particle and exposed amount of the colorant on the toner surface is reduced due to the difference between the affinity of the colorant and oil phase ingredients and the affinity of the colorant and an aqueous medium by dissolving or dispersing the resin and the colorant in an organic solvent in which the toner constituting resin is allowed to be dissolved while dispersing the oil phase ingredients in the aqueous media and thereby granulating particles.

DETAILED DESCRIPTION OF THE INVENTION

Figure 1:
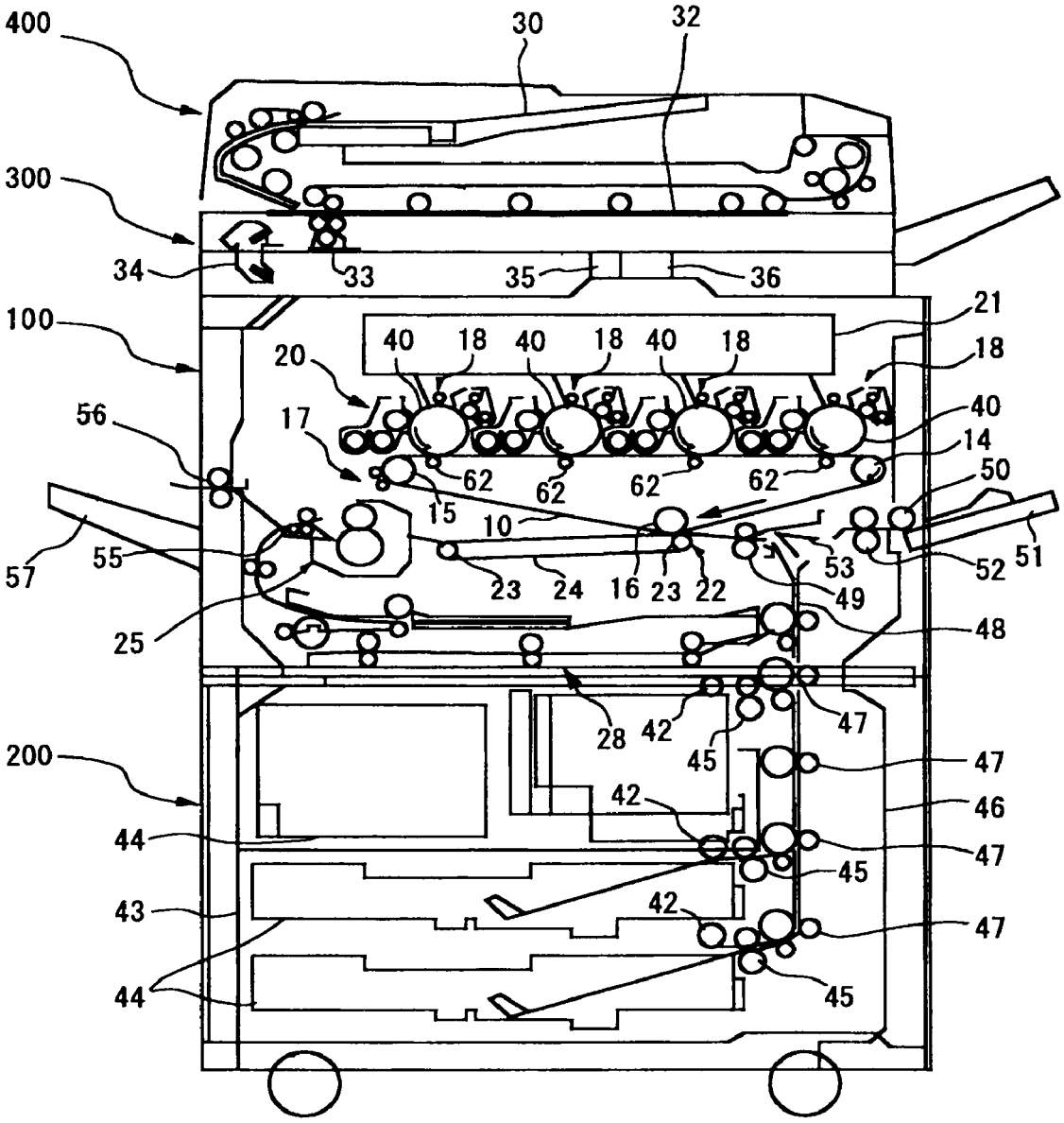
FIG. 1 is a schematic illustration view showing an example of an image forming apparatus used in the present invention.

In the following, the preferable embodiment of the present invention is described with reference to the accompanying drawings. The toner for image formation of the present invention (hereinbelow simply referred to as a "toner".) contains a pigment as a colorant, and the toner can provide an excellent coloring ability and a wide color reproduction space as a result of using a pigment dispersant for dispersing the pigment. As a pigment dispersant which can disperse the pigment in the toner well, a polymer dispersant is preferable. It is required that this pigment dispersant has compatibility with a binder resin at least. However, when the compatibility is excessively good, the glass transition temperature of the binder resin is lowered due to so-called plasticization effect. This lowers the glass transition temperature of the toner, which leads to deterioration in the storage stability of the toner, particularly the storage stability during transfer and causes a blocking phenomenon of the toner during transfer. Owing to this, it is necessary that the binder resin and the pigment dispersant have moderate compatibility, and higher melting point of the pigment dispersant is more advantageous for the storage stability of the toner as well. However, when the melting point of the pigment dispersant is too high, adverse effects are caused on the fixing properties of the toner. Low temperature fixing properties deteriorate in particular. Therefore, the melting point of the pigment dispersant is limited within the range of 20° C. to 80° C. When the melting point is over 80° C., the low temperature fixing properties deteriorate and when the melting point is less than 20° C., offset resistance deteriorates.

In addition, when the binder resin has a glass transition temperature designated as a, and a mixture of the binder resin and the pigment dispersant in the mixing ratio represented by Expression 1 (binder resin:pigment dispersant=100:5 (mass ratio)) has a glass transition temperature designated as $\beta$, $\alpha$ and $\beta$ shall have a relation shown by Expression 2 ($0° C. \leqq \alpha - \beta \leqq 10° C.$). As one index, a toner in which $\alpha$, the glass transition temperature of the binder resin, and $\beta$, the glass transition temperature of the mixture of the binder resin and the pigment dispersant in a ratio of (binder resin:pigment dispersant=100:5 (mass ratio)) meet a predetermined relation, lowering of the glass transition temperature of the binder resin due to the so-called plasticization effect can be suppressed.

Furthermore, adverse effects are caused on the charging characteristics of the toner when the pigment dispersant has an amine value. It is thought that an amine value imparting component in the pigment dispersant affects the charging characteristics of the toner, particularly on those of a negatively chargeable toner. For this reason, it is necessary to have pigment dispersibility and an appropriate amine value from a view point of the charging characteristics.

When the acid value of the pigment dispersant is more than 50 mgKOH/g, a precursor reaction may be inhibited. An active hydrogen-containing compound is used for the precursor as a cross-linking or elongation agent. The active hydrogen-containing compound is a basic material, and when the acid value of the pigment dispersant is high, the cross-linking or elongation agent binds to an acidic group of the pigment dispersant and thus the reaction with the precursor is inhibited.

Deterioration in the fixing characteristics of the toner, particularly hot offset resistance is hereby observed. Deterioration in the storage stability of the toner is also caused when the precursor has a low molecular mass component. In addition, when the acid value of the pigment dispersant is less than 28 mgKOH/g, compatibility with a binder resin becomes insufficient, and deterioration in the pigment dispersibility of the toner is observed.

Furthermore, the content of the pigment dispersant in the toner should be optimized so as to achieve the characteristics stated above. When the content of the pigment dispersant in the toner is insufficient, deterioration in the pigment dispersibility will be resulted, and when the content in the toner is excessively high, deterioration in the storage stability, charging characteristics and fixing characteristics stated above will appear.

On this account, the content of the pigment dispersant of the toner is 0.1% by mass to 5% by mass. When the content is less than 0.1% by mass, dispersion characteristics of the colorant are poor and color development characteristics and OHP optical transparency of the toner deteriorate. When the content is more than 5% by mass, offset resistance deteriorates.

The aqueous medium can be appropriately selected from conventionally known media.

Specific examples thereof include water, solvents miscible with water and mixtures thereof and, among these, water is particularly preferable. Examples of the solvent miscible with water include alcohols, dimethylformamide, tetrahydrofuran, cellosolves, ketones having 1 to 10 carbon atoms. Examples of the alcohols include methanol, isopropanol and ethylene glycol. Examples of the lower ketones include acetone and methyl ethyl ketone. These can be used singly or as a combination of two or more thereof.

In the present invention, an oil phase which is a liquid containing toner constituting materials preferably contains the toner constituting materials dissolved or dispersed in a solvent. The solvent preferably contains an organic solvent. Here, it is preferable that the organic solvent is removed when or after the toner base particles are formed.

The organic solvent can be appropriately selected depending on the purpose, but those having a boiling point less than 150° C. are preferable since they can be readily removed. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Among these, toluene, xylene, benzene, methylene chloride, 1,2-dichloroethane, chloroform and carbon tetrachloride are preferable, and ethyl acetate is particularly preferable. These can be used singly or as a combination of two or more thereof.

The amount of the organic solvent can be appropriately selected depending on the purpose, but it is preferably 40 parts by mass to 300 parts by mass, more preferably 60 parts by mass to 140 parts by mass, and yet more preferably 80 parts by mass to 120 parts by mass with respect to 100 parts by mass of the toner constituting materials.

The toner constituting materials can be appropriately selected depending on the purpose. They typically contain either one of monomers, polymers, active hydrogen-containing compounds and polymers having reactivity with an active hydrogen group, preferably further contain a colorant, and may further contain other components such as a releasing agent and a charge control agent as required.

The mixing ratio of a colorant and an organic solvent in a liquid containing toner constituting materials can be appropriately selected depending on the purpose and it is preferably 5:95 to 50:50. When the blending ratio of the colorant is less than this range, the amount of the organic solvent becomes excessive at the time of the production of the toner, which may lower production efficiency of the toner, and when the blending ratio of the colorant is more than this range, dispersion of the pigment may become insufficient.

The colorant is not particularly limited and may be appropriately selected from conventionally known dyes and colorants depending on the intended purpose. Examples thereof include Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone and mixtures thereof. Particularly preferred examples of colorants include Pigment Red PR122, PR269, PR184, PR57:1, PR238, PR146, PR185; Pigment Yellow PY93, PY128, PY155, PY180, PY74; Pigment Blue PB15:3. These may be used alone or in combination.

The colorant may be dispersed in a solvent together with a pigment dispersant, a binder resin and the like, or may be used as a colorant dispersion liquid obtained by dispersing a colorant in a solvent. Part of the pigment dispersant, binder resin and the like may be added when the colorant is dispersed in the solvent so as to adjust viscosity, and hence an appropriate shearing force may be applied.

It is preferred that the particle size of the dispersed colorant is 1 μm or less. When a toner produced with a colorant having a dispersed particle size of more than 1 μm is used, image quality may tend to deteriorate, and particularly optical transparency of OHP may tend to deteriorate.

The particle size of the dispersed colorant can be measured with a particle size distribution measuring apparatus, Microtrac ultra-fine particles size distribution analyzer UPA-EX150 (manufactured by Nikkiso Co., Ltd.), using laser doppler method.

The content of the colorant in the toner can be selected depending on the purpose appropriately, but it is typically 1% by mass to 15% by mass, and preferably 3% by mass to 10% by mass. When the content of the colorant is less than 1% by mass, coloring ability of the toner decreases and when the content of the colorant is more than 15% by mass, defective dispersion of the pigment may occur in the toner, leading to reduction in the coloring ability and electrical characteristics of the toner.

In the present invention, the aqueous medium preferably contains a polymer dispersant. Here, the polymer dispersant is preferably a water-soluble polymer. The water-soluble polymer can be appropriately selected from conventionally known materials, and examples thereof include sodium carboxymethylcellulose, hydroxyethyl cellulose and polyvinyl alcohol. These can be used alone or in combination.

The emulsification or dispersing of the solution or dispersion liquid of toner material in the aqueous medium is preferably effected by dispersing the solution or dispersion liquid in the aqueous medium with stirring.

The method of dispersing is not particularly limited and can be selected from conventionally known dispersing devices. Examples thereof include a low-speed shear disperser, high-speed shear disperser, friction disperser, high-pressure jet disperser, and supersonic disperser. Among these, a high-speed shear disperser is preferable because it is capable of adjusting the particle diameter of dispersion (oil droplets) to be within the range of 2 μm to 20 μm.

When a high-speed shear disperser is used, the rotational speed, dispersing time, dispersing temperature, etc., are not particularly limited and can be determined depending on the intended purpose. For example, the rotational speed is preferably 1,000 rpm to 30,000 rpm and more preferably 5,000 rpm to 20,000 rpm. The dispersing time is preferably 0.1 min to 5 min in the case of batch method. The dispersing temperature is preferably 0° C. to 150° C., more preferably 40° C. to 98° C. under pressure. In general, dispersing can be more easily effected at higher temperatures.

The method to form the toner base particles can be appropriately selected from conventionally known methods. Specific examples thereof include a method in which base particles of a toner are formed in accordance with a suspension polymerization method, an emulsion polymerization coagulation method, a dissolution suspension method or the like and a method to form toner base particles while generating an adhesive base material. Among these, the method to form toner base particles while generating an adhesive base material is preferable. Here, the adhesive base material is a base material having adhesiveness to recording media such as paper.

The method to form toner base particles while generating an adhesive base material is a method in which the toner constituting materials contain an active hydrogen-containing compound and a polymer having reactivity to the active hydrogen group and the toner base particles are formed while generating an adhesive base material by reacting the active hydrogen-containing compound and the polymer having reactivity to the active hydrogen group in an aqueous medium. In addition to these, the adhesive base material may also contain a conventionally known binder resin.

The toner obtained in this way contains a colorant and, where necessary, may further contain additional ingredients such as a releasing agent a charge control agent and the like.

The mass-average molecular mass of the adhesive base material is preferably 3,000 or more, more preferably 5,000 to 1,000,000, and most preferably 7,000 to 500,000. When the mass-average molecular mass is less than 3,000, hot offset resistance may decrease.

The glass transition temperature of the adhesive base material is preferably 40° C. to 65° C., more preferably 45° C. to 65° C. When the glass transition temperature is less than 40° C. or less, it may result in poor heat resistant storage stability. When the glass transition temperature is greater than 65° C., it may result in insufficient low temperature fixing ability. However, a toner that contains as an adhesive base material a polyester resin prepared by crosslinking reaction or elongation reaction offers excellent storage stability even when the glass transition temperature is low.

The adhesive base material can be appropriately selected depending on the intended purpose; preferable examples thereof include polyester resins.

The precursor is not particularly limited and can be appropriately selected depending on the intended purpose; suitable examples thereof include modified polyester resins capable of reacting with active hydrogen group-containing compounds.

As the modified polyester resins, isocyanate group-containing polyesters are preferable as a polymer that is reactive with active hydrogen group.

Moreover, urethane bonds may be formed by addition of an alcohol upon reaction of an isocyanate group-containing polyester resin and an active hydrogen group-containing compound. The mole ratio of urethane bonds to urea bonds (as defined for the purpose of distinguishing from the urethane bonds in an isocyanate group-containing polyester prepolymer) is preferably 0 to 9, more preferably 1/4 to 4, and most preferably 2/3 to 7/3. When this molar ratio is greater than 9, hot offset resistance may decrease.

Specific examples of the adhesive base material include the following compounds (1) to (10):

(1) a mixture of a polycondensation product of 2 mol ethyleneoxide adduct of bisphenol A and isophthalic acid; and a compound obtained by urea-modifying a polyester prepolymer with isophorone diamine, w herein the polyester prepolymer is obtained by reacting a polycondensation product of 2 mol ethyleneoxide adduct of bisphenol A and isophthalic acid with isophorone diisocyanate.

(2) a mixture of: a polycondensation product of 2 mol ethylene oxide adduct of bisphenol A and terephthalic acid; and a compound obtained by urea-modifying a polyester prepolymer with isophorone diamine, wherein the polyester prepolymer is obtained by reacting a polycondensation product of 2 mol ethylene oxide adduct of bisphenol A and isophthalic acid with isophorone diisocyanate.

(3) a mixture of: a polycondensation product of 2 mol ethylene oxide adduct of bisphenol A, 2 mol propylene oxide adduct of bisphenol A, and terephthalic acid; and a compound obtained by urea-modifying a polyester prepolymer with isophorone diamine, wherein the polyester prepolymer is obtained by reacting a polycondensation product of 2 mol ethylene oxide adduct of bisphenol A, 2 mol propylene oxide adduct of bisphenol A, and terephthalic acid with isophorone diisocyanate.

(4) a mixture of a polycondensation product of 2 mol propylene oxide adduct of bisphenol A, and terephthalic acid; and a compound obtained by urea-modifying a polyester prepolymer with isophorone diamine, wherein the polyester prepolymer is obtained by reacting a polycondensation product of 2 mol ethylene oxide adduct of bisphenol A, 2 mol propylene oxide adduct of bisphenol A, and terephthalic acid with isophorone diisocyanate.

(5) a mixture of: a polycondensation product of 2 mol ethylene oxide adduct of bisphenol A, and terephthalic acid; and a compound obtained by urea-modifying a polyester prepolymer with hexamethylene diamine, wherein the polyester prepolymer is obtained by reacting a polycondensation product of 2 mol ethylene oxide adduct of bisphenol A, and terephthalic acid with isophorone diisocyanate.

(6) a mixture of a polycondensation product of 2 mol ethylene oxide adduct of bisphenol A, 2 mol propylene oxide adduct of bisphenol A, and terephthalic acid; and a compound obtained by urea-modifying a polyester prepolymer with hexamethylene diamine, wherein the poly ester prepolymer is obtained by reacting a polycondensation product of 2 mol ethylene oxide adduct of bisphenol A, and terephthalic acid with isophorone diisocyanate.

(7) a mixture of a polycondensation product of 2 mol ethylene oxide adduct of bisphenol A, and terephthalic acid; and a compound obtained by urea-modifying a polyester prepolymer with ethylene diamine, wherein the polyester prepolymer is obtained by reacting a polycondensation product of 2 mol ethylene oxide adduct of bisphenol A, and terephthalic acid with isophorone diisocyanate.

(8) a mixture of a polycondensation product of 2 mol ethylene oxide adduct of bisphenol A, and isophthalic acid; and a compound obtained by urea-modifying a polyester prepolymer with hexamethylene diamine, wherein the polyester prepolymer is obtained by reacting a polycondensation product of 2 mol ethylene oxide adduct of bisphenol A, and isophthalic acid with diphenylmethane diisocyanate.

(9) a mixture of a polycondensation product of 2 mol ethylene oxide adduct of bisphenol A, 2 mol propylene oxide adduct of bisphenol A, and terephthalic acid; and a compound obtained by urea-modifying a polyester prepolymer with hexamethylene diamine, wherein the poly ester prepolymer is obtained by reacting a polycondensation product of 2 mol ethylene oxide adduct of bisphenol A, 2 mol propylene oxide adduct of bisphenol A, terephthalic acid, and dodecenylsuccinic anhydride with diphenylmethane diisocyanate.

(10) a mixture of a polycondensation product of 2 mol ethylene oxide adduct of bisphenol A, and isophthalic acid; and a compound obtained by urea-modifying a polyester prepolymer with hexamethylene diamine, wherein the polyester prepolymer is obtained by reacting a polycondensation product of 2 mol ethylene oxide adduct of bisphenol A, and isophthalic acid with toluene diisocyanate.

The active hydrogen group-containing compound functions as elongation agent or crosslinking agent when a polymer reactive with the active hydrogen group-containing compound undergoes an elongation or crosslinking reaction in an aqueous medium.

Specific examples of the active hydrogen group include hydroxyl groups (e.g., alcoholic hydroxyl group and phenolic hydroxyl group), amino group, carboxyl group, and mercapto group. These may be used alone or in combination.

The active hydrogen group-containing compound can be appropriately selected depending on the intended purpose.

For example, in cases where the polymer reactive with the active hydrogen group is an isocyanate group-containing polyester prepolymer, amines are preferable since the molecular mass can be increased by the elongation reaction or crosslinking reaction with the polyester prepolymer.

The amines are not particularly limited and can be appropriately selected depending on the intended purpose; examples thereof include diamines, trivalent or higher polyamines, amino alcohols, amino mercaptans, amino acids, and the above amines in which amino groups are blocked. Among these, diamines, and mixtures of diamines with a small amount of the trivalent or higher polyamines are particularly preferable. These amines may be used along or in combination.

Examples of the diamines include aromatic diamines, alicyclic diamines and aliphatic diamines. Examples of the aromatic diamines include phenylene diamine, diethyltoluene diamine and 4,4'-diaminophenylmethane. Examples of the alicyclic diamines include 4,4'-diamino-3,3'-dimethyldicycrohexylmethane, diaminocyclohexane and isophorone diamine. Examples of the aliphatic diamines include ethylene diamine, tetramethylene diamine and hexamethylene diamine. Examples of the trivalent or higher polyamines include diethylene triamine and triethylene tetramine. Examples of the amino alcohols include ethanolamine and hydroxyethylaniline. Examples of the amino mercaptans include aminoethylmercaptan and aminopropylmercaptan. Examples of the amino acids include amino propionic acid and amino capric acid. Specific examples of the above amines with blocked amino groups include ketimine compounds and oxazoline compounds, which are obtained by blocking the amino groups of the above amines with a ketone such as acetone, methyl ethyl ketone or methyl isobutyl ketone.

A reaction terminator may be used to stop the elongation reaction, crosslinking reaction or the like between the active hydrogen group-containing compound and the polymer reactive with the active hydrogen group. The reaction terminator is preferably employed for adjusting the molecular mass, etc., of the adhesive base material to be within a preferable range. Specific examples of the reaction terminator include monoamines such as diethylamine, dibutylamine, butylamine and laurylamine, and ketimine compounds obtained by blocking amino groups of the monoamines.

The ratio of the equivalent mass of isocyanate group in the polyester prepolymer to the equivalent mass of amino group in the amine is preferably from 1/3 to 3/1, more preferably from 1/2 to 2/1, and most preferably from 2/3 to 1.5/1. When this ratio is less than 1/3, the low-temperature fixing ability may be decreased. When the ratio is more than 3/1, the molecular mass of the urea-modified polyester decreases, possibly impairing the hot offset resistance.

The polymer reactive with an active hydrogen group (hereinafter sometimes referred to as "prepolymer") can be appropriately selected from conventionally known resins and the like, with examples thereof including polyol resins, polyacrylic resins, polyester resins, epoxy resins, and derivatives thereof. Among these, polyester resins are especially preferable for their higher flowability and transparency when melted. These may be used alone or in combination.

Examples of functional groups reactive with the active hydrogen group of the prepolymer include an isocyanate group, epoxy group, carboxyl group, and a functional group expressed by the formula —COCl, with an isocyanate group being preferable. The prepolymer may contain one or more of these functional groups.

As the prepolymer, it is preferable to use a polyester resin having an isocyanate group or the like that can produce urethane bonds, since by so doing the molecular mass of polymer components can be readily adjusted and oilless low-temperature fixing ability can be ensured in dry toner, particularly since it is possible to ensure excellent releasing ability and fixing ability even when no oil supply mechanism is provided for providing a releasing oil to the heated medium for toner fixing.

The isocyanate group-containing polyester prepolymer can be appropriately selected depending on the intended purpose; specific examples thereof include reaction products of polyisocyanate and active hydrogen group-containing polyester resins obtained by polycondensation of polyols with polycarboxylic acids.

The polyols are not particularly limited and can be appropriately selected depending on the intended purpose; examples include diols, trivalent or higher alcohols, and mixtures of diols and trivalent or higher alcohols. Among these, preferable are diols and mixtures of diols and a small amount of trivalent or higher alcohols. These may be used alone or in combination.

Specific examples of the diols include alkylene glycols such as ethylene glycol, 1,2-propylene glycol, 1,3-propylene glycol, 1,4-butanediol, and 1,6-hexanediol; oxyalkylene group-containing diols such as diethylene glycol, triethylene glycol, dipropylene glycol, polyethylene glycol, polypropylene glycol, and polytetramethylene ether glycol; alicyclic diols such as 1,4-cyclohexane dimethanol and hydrogenated bisphenol A; alkylene oxide adducts of the alicyclic diols, such as those obtained by adding an alkylene oxide such as ethylene oxide, propylene oxide, butylene oxide or the like to the alicyclic diols; bisphenols such as bisphenol A, bisphenol F, and bisphenol S; and alkylene oxide adducts of bisphenols, such as those obtained by adding an alkylene oxide such as ethylene oxide, propylene oxide, or butylene oxide to the bisphenols. The number of carbon atoms of the alkylene glycols is preferably 2 to 12. Among these, preferable are alkylene glycols having 2 to 12 carbon atoms and alkylene oxide adducts of bisphenols, with alkylene oxide adducts of bisphenols and mixtures of alkylene oxide adducts of bisphenols and alkylene glycols having 2 to 12 carbon atoms being most preferable.

Examples of the trivalent or higher alcohols include trivalent or higher aliphatic alcohols, trivalent or higher polyphenols, or alkylene oxide adducts of trivalent or higher polyphenols are preferable. Examples of the trivalent or higher aliphatic alcohols include glycerine, trimethylol ethane, trimethylol propane, pentaerythritol, and sorbitol. Examples of the trivalent or higher polyphenols include trisphenol PA, phenol novolac, and cresol novolac. Specific examples of the alkylene oxide adducts of above-mentioned trivalent or higher polyphenols include those obtained by adding an alkylene oxide such as ethylene oxide, propylene oxide, or butylene oxide to trivalent or higher polyphenols. When the diol and trivalent or higher alcohol is to be mixed, the mass ratio of the trivalent or higher alcohol relative to the diol is preferably 0.01% by mass to 10% by mass, more preferably 0.01% by mass to 1% by mass.

The polycarboxylic acids are not particularly limited and can be appropriately selected depending on the intended purpose; examples thereof include dicarboxylic acids, trivalent or higher carboxylic acids, and mixtures thereof, with dicarboxylic acids and the mixtures of dicarboxylic acids and a small amount of trivalent or higher carboxylic acids being preferable. These polycarboxylic acids may be used alone or in combination.

Examples of the dicarboxylic acids include dialkanoic acids, dialkenoic acids, and aromatic dicarboxylic acids.

Examples of the dialkanoic acids include succinic acid, adipic acid, and sebacic acid. The number of carbon atoms of the dialkenoic acids preferably is 4 to 20, with specific examples being maleic acid, fumaric acid, and the like. The number of carbon atoms of the aromatic dicarboxylic acids is preferably 8 to 20, with specific examples being phthalic acid, isophthalic acid, terephthalic acid, naphthalendicarboxylic acid, and the like. Among these, dialkenoic acids having 4 to 20 carbon atoms and aromatic dicarboxylic acids having 8 to 20 carbon atoms are preferable.

As the trivalent or higher carboxylic acids, trivalent or higher aromatic carboxylic acids can be used, which preferably have 9 to 20 carbon atoms. Examples thereof include trimellitic acid, and pyromellitic acid.

The polycarboxylic acids may also be acid anhydrides or lower alkyl esters of any of dicarboxylic acids, trivalent or higher carboxylic acids, and mixtures thereof. Examples of the lower alkyl ester include methyl ester, ethyl ester, and isopropyl ester.

When the dicarboxylic acid and trivalent or higher carboxylic acid is to be mixed, the mass ratio of the trivalent or higher carboxylic acid relative to the dicarboxylic acid is preferably 0.01% by mass to 10% by mass, more preferably 0.01% by mass to 1% by mass.

The ratio of the equivalent mass of hydroxyl group in the polyol to the equivalent mass of carboxyl group in the polycarboxylic acid upon polycondensation of the polyol with polycarboxylic acid is preferably 1 to 2, more preferably 1 to 1.5, and most preferably 1.02 to 1.3.

The amount of the polyol-derived component in the isocyanate group-containing polyester prepolymer is preferably 0.5% by mass to 40% by mass, more preferably 1% by mass to 30% by mass and most preferably 2% by mass to 20% by mass. When the amount is less than 0.5% by mass, it may result in poor hot offset resistance, which makes it difficult to ensure heat resistant storage stability and low-temperature fixing ability at the same time. When the amount is greater than 40% by mass, it may result in poor low-temperature fixing ability.

The above polyisocyanates are not particularly limited and can be appropriately selected depending on the intended purpose; examples thereof include aliphatic diisocyanates, alicyclic diisocyanates, aromatic diisocyanates, aromatic aliphatic diisocyanates, isocyanurates, and blocked products thereof blocked using phenol derivative, oxime, caprolactam, or the like.

Examples of the aliphatic diisocyanates include tetramethylene diisocyanate, hexamethylene diisocyanate, 2,6-diisocyanate methyl caproate, octamethylene diisocyanate, decamethylene diisocyanate, dodecamethylene diisocyanate, tetradecamethylene diisocyanate, trimethyl hexane diisocyanate, and tetramethyl hexane diisocyanate. Examples of the alicyclic polyisocyanates include isophorone diisocyanate, and cyclohexylmethane diisocyanate. Examples of the aromatic diisocyanates include tolylene diisocyanate, diphenylmethane diisocyanate, 1,5-naphthylene diisocyanate, diphenylene-4,4'-diisocyanate, 4,4'-diisocyanato-3,3'-dimethyl diphenyl, 3-methyldiphenyl methane-4,4'-diisocyanate, and diphenylether-4,4'-diisocyanate. Examples of the aromatic aliphatic diisocyanates include $\alpha,\alpha,\alpha',\alpha'$-tetramethyl xylylene diisocyanate. Examples of the isocyanurates include tris-isocyanatoalkyl-isocyanurate, and tris(isocyanatocycroalkyl)isocyanurate. These may be used alone or in combination.

In general, the ratio of the equivalent mass of isocyanate group in the polyisocyanate to the equivalent mass of hydroxyl group in the polyester resin upon reaction of the polyisocyanate with hydroxyl group-containing polyester resin is preferably 1 to 5, more preferably 1.2 to 4, and most preferably 1.5 to 3. When this ratio is greater than 5, it may result in poor low-temperature fixing ability. When the ratio is less than 1, it may result in poor offset resistance.

The amount of the polyisocyanate-derived component in the isocyanate group-containing polyester prepolymer is preferably 0.5% by mass to 40% by mass, more preferably 1% by mass to 30% by mass, and further preferably 2% mass to 20% by mass. When the amount is less than 0.5% by mass, it may result in poor offset resistance. When the amount is greater than 40% by mass, it may result in poor low-temperature fixing ability.

The average number of isocyanate groups per one molecule of the polyester prepolymer is preferably 1 or more, more preferably 1.2 to 5, and most preferably 1.5 to 4. When the average number is less than 1, the molecular mass of the urea-modified polyester resin decreases and thus hot offset resistance may decrease.

The mass-average molecular mass of the polymer reactive with an active hydrogen group is preferably 1,000 to 30,000, more preferably 1,500 to 15,000. When the mass-average molecular mass is less than 1,000, it may result in poor heat resistant storage stability. When the mass-average molecular mass is greater than 30,000, it may result in poor low-temperature fixing ability. The mass average molecular mass can be obtained by tetrahydrofuran (THF)-soluble matter by gel permeation chromatography (GPC) as follows.

At first, a column is equilibrated in a heat chamber at the interior temperature of 40° C. At this temperature tetrahydrofuran (THF), a column solvent, is passed through the column at the flow rate of 1 ml/min. To this column, 50 μl to 200 μl of tetrahydrofuran solutions with sample concentrations of 0.05% by mass to 0.6% by mass are added. In this measurement, the molecular mass distribution is obtained from the relationship between the logarithm values of calibration curve prepared from several standard samples and counts. The standard samples for calibration are, for example, standard monodispersed polystyrene samples respectively having a molecular mass of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ (available from Pressure Chemical Co. or Toyo Soda Co. Ltd.) It is preferable to use about 10 standard samples. Note that a refractive index (RI) detector can be used as a detector.

In the present invention any binder resin can be appropriately used depending on the intended purpose, and polyester resins and the like can be used; however, unmodified polyester resins are preferable. By using such unmodified polyester resins the low-temperature fixing ability and glossiness can be improved.

Examples of the unmodified polyester resins include polycondensates of polyols and polycarboxylic acids. It is preferable that a part of the unmodified polyester resin be compatibilized with a urea-modified polyester resin, i.e., that the unmodified polyester resin and urea-modified polyester resin have similar structure that enables compatibilization, for the purpose of improving the low-temperature fixing ability and hot offset resistance.

The mass-average molecular mass of the unmodified polyester resin is preferably 1,000 to 30,000, more preferably 1,500 to 15,000. When the mass-average molecular mass is less than 1,000, it may result in poor heat resistant storage stability. For this reason, it is preferable that the amount of components having a mass-average molecular mass of less than 1,000 be 8% by mass to 28% by mass. When the mass-average molecular mass is greater than 30,000, it may result in poor low-temperature fixing ability.

The glass transition temperature of the unmodified polyester resin is preferably 30° C. to 70° C., more preferably 35° C. to 60° C., and further preferably 35° C. to 55° C. When the glass transition temperature is less than 30° C., it may result in poor heat resistant storage stability. When the glass transition temperature is greater than 70° C., it may result in poor low-temperature fixing ability.

The hydroxyl value of the unmodified polyester resin is preferably 5 mgKOH/g or more, more preferably 10 mgKOH/g to 120 mgKOH/g, and further preferably 20 mgKOH/g to 80 mgKOH/g. When the hydroxyl value is less than 5 mgKOH/g, it may become difficult to ensure excellent heat resistant storage stability and low-temperature fixing ability.

The acid value of the unmodified polyester resin is 1.0 mgKOH/g to 50.0 mgKOH/g, more preferably 1.0 mgKOH/g to 30.0 mgKOH/g. By setting the acid value within these ranges, the resultant toner becomes likely to be negatively charged.

When a toner contains an unmodified polyester resin, the mass ratio of the isocyanate group-containing polyester prepolymer to the unmodified polyester resin is preferably 5/95 to 25/75, more preferably 10/90 to 25/75. When the mass ratio is less than 5/95, it may result in poor hot offset resistance. When the mass ratio is greater than 25/75, it may result in poor low-temperature fixing ability and low glossiness.

In addition to the above-mentioned ingredients, the toner of the present invention can further contain a releasing agent, charge control agent, finer resin particles, fine inorganic particles, flow improver, cleaning improver, magnetic material, metallic soap, etc.

The releasing agent is not particularly limited and can be appropriately selected from those known in the art; examples thereof include carbonyl group-containing waxes, polyolefin waxes, and long-chain hydrocarbons. Among these, carbonyl group-containing waxes are preferable. These may be used alone or in combination.

Examples of the carbonyl group-containing wax include esters having alkanoic acid residues such as carnauba wax, montan wax, trimethylolpropane tribehenate, pentaerythritol tetrabehenate, pentaerythritol diacetate dibehenate, glycerin tribehenate, and 1,18-octadecan diol distearate; esters having alkanol residues such as trimellitic tristearate and distearyl maleate; amides having alkanoic acid residues such as dibehenyl amide; amides having monoamine residues such as trimellitic acid tristearyl amide; and dialkyl ketones such as distearyl ketone. Among these, esters having polyalkanoic acid residues are most preferable. Examples of the polyolefin waxes include polyethylene wax and polypropylene wax. Examples of the long-chain hydrocarbons include paraffin waxes and Sasol waxes.

The melting point of the above waxes (releasing agents) is preferably 40° C. to 160° C., more preferably 50° C. to 120° C., and particularly preferably 60° C. to 90° C. When the melting point is less than 40° C., it may adversely affect the heat resistant storage stability of wax. When the melting point is greater than 160° C., it may result in cold offset upon low-temperature fixing.

The melt viscosity of the releasing agent, as measured at a temperature that is 20° C. higher than the melting point of the wax, is preferably 5 cps to 1,000 cps, more preferably 10 cps to 100 cps. When the melt viscosity is less than 5 cps, it may result in poor releasing ability. When the melt viscosity is greater than 1,000 cps, it may result in failure to provide the effects of improving the offset resistance and the low-temperature fixing ability.

The amount of the releasing agent of the toner is preferably 0% by mass to 40% by mass, more preferably 3% by mass to 30% by mass. When the amount of the releasing agent is greater than 40% by mass, it may result in poor toner flowability.

The charge control agent is not particularly limited and can be appropriately selected from those known in the art depending on the intended purpose; it is preferable to employ such a charge control agent that is close to either transparent or white as those made of colored materials change the color tone. Examples of the charge control agent include triphenylmethane dyes, molybdic acid chelate pigments, rhodamine dyes, alkoxy amines, quaternary ammonium salts such as fluorine-modified quaternary ammonium salts, alkylamides, phosphorous or compounds thereof, tungsten or compounds thereof, fluorine surfactants, metallic salts of salicylic acid, and metallic salts of salicylic acid derivatives. These may be used alone or in combination.

The charge control agent may be any of commercially available products; specific examples thereof include Bontron P-51 (quaternary ammonium salt), Bontron E-82 (oxynaphthoic acid metal complex), Bontron E-84 (salicylic acid metal complex), and Bontron E-89 (phenol condensate) available from Orient Chemical Industries, Ltd.; TP-302 and TP-415 (both quaternary ammonium salt molybdenum metal complex) available from Hodogaya Chemical Co.); Copy Charge PSY VP2038 (quaternary ammonium salt), Copy Blue PR (triphenylmethane derivative), Copy Charge NEG VP2036 and Copy Charge NX VP434 (both quaternary ammonium salt) available from Hoechst Ltd.; LRA-901 and LR-147 (both boron metal complex) available from Japan Carlit Co., Ltd.; and quinacridone, azo pigment and other high-molecular mass compounds having sulfonic group, carboxyl group, quaternary ammonium salt, or the like.

The charge control agent may be dissolved and/or dispersed in the toner material after kneading with a masterbatch, may be dissolved or dispersed into a solvent together with toner ingredients, or may be immobilized to the surface of the resultant toner particles.

The amount of the charge control agent in the toner depends on the type of binder resin, presence of additives, and method of dispersing; however, it is preferably 0.1% by mass to 10% by mass, and more preferably 0.2% by mass to 5% by mass based on the amount of the binder resin. When charge control agent content is less than 0.1% by mass, it may result in poor charge control. When the content is greater than 10% by mass, the charge amount of toner becomes so high that the electrostatic attraction force that attracts toner particles to the developing roller increases, which may cause reduction in developer flowability or poor image density.

The resin particles are not particularly limited as long as they resins capable of forming an aqueous dispersion liquid in an aqueous medium, and any resin can be selected from those known in the art. The fine resin particles may be made of either thermoplastic resin or thermosetting resin. Specific examples thereof include vinyl resins, polyurethane resins, epoxy resins, polyester resins, polyamide resins, polyimide resins, silicone resins, phenol resins, melamine resins, urea resins, aniline resins, ionomer resins, and polycarbonate resins. Among these, the fine resin particles are preferably formed of at least one resin selected from the group consisting of vinyl resins, polyurethane resins, epoxy resins and polyester resins, because an aqueous dispersion liquid of fine, spherical resin particles can be readily prepared. These resins may be used alone or in combination.

The vinyl resins are polymers prepared by homopolymerization or copolymerization of a vinyl monomer. Specific examples of the vinyl resins include styrene-(meth)acrylate resins, styrene-butadiene copolymers, (meth)acrylate-acrylic acid ester copolymers, styrene-acrylonitrile copolymers, styrene-maleic anhydride copolymers, and styrene-(meth)acrylate copolymers.

The fine resin particles may be formed of a copolymer prepared by polymerization of a monomer containing two or more unsaturated groups. Such a monomer can be appropriately selected depending on the intended purpose; examples thereof include a sodium salt of sulfate ester of methacrylic acid ethylene oxide adduct (Eleminol RS-30, available from Sanyo Chemical Industries, Ltd.), divinylbenzene, and 1,6-hexane-diol acrylate.

The fine resin particles may be prepared by any known polymerization method, and are preferably prepared as an aqueous dispersion liquid. Examples of the method of preparation of the aqueous dispersion liquid of the fine resin particles include, in the case of vinyl resins, a method of polymerizing a vinyl monomer by suspension-polymerization, emulsification polymerization, seed polymerization, or dispersion-polymerization; and in the case of polyaddition resins and condensation resins such as polyester resins, polyurethane resins and epoxy resins, a method in which a precursor (monomer, oligomer or the like) or solution containing the precursor is dispersed in an aqueous medium in the presence of a dispersant, and cured by heating or addition of a curing agent, a method in which a suitably selected emulsifier is dissolved in a precursor (monomer, oligomer or the like) or solution containing the precursor followed by addition of water to effect phase inversion emulsification, a method in which a resin is pulverized with a mechanical rotation-type, or jet-type pulverizer followed by classification to produce resin particles, and the resin particles are dispersed in water under the presence of a suitable dispersant, a method in which resin particles are deposited by addition of a poor solvent to resin solution or by cooling resin solution prepared by dissolving resin into a solvent by heating, the solvent is removed, and the resin particles is dispersed in an aqueous medium under the presence of a suitable dispersant, a method in which resin solution is dispersed in water under the presence of a suitable dispersant, followed by solvent removal by heating and vacuuming, and a method in which a suitable emulsifier is added into a resin solution, followed by phase inversion emulsification by addition of water.

The fine inorganic particles are not particularly limited and can be appropriately selected from those known in the art depending on the intended purpose; examples thereof include fine particles made of silica, alumina, titanium oxide, barium titanate, magnesium titanate, calcium titanate, strontium titanate, zinc oxide, tin oxide, quartz sand, clay, mica, silicic pyroclastic rock, diatomaceous earth, chromic oxide, cerium oxide, iron oxide red, antimony trioxide, magnesium oxide, zirconium oxide, barium sulfate, barium carbonate, calcium carbonate, silicon carbide, or silicon nitride. These may be used alone or in combination.

The primary particle diameter of the fine inorganic particles is preferably 5 nm to 2 μm, more preferably 5 nm to 500 nm. The specific surface area of the fine inorganic particles, as measured by BET method, is preferably 20 $m^2/g$ to 500 $m^2/g$.

The amount of the fine inorganic particle in the toner is preferably 0.01% by mass to 5.0% by mass, more preferably 0.01% by mass to 5.0% by mass.

Surface treatment with the flow improver improves the hydrophobic nature of the toner surface, preventing degradation of flowability and charging ability under high-humidity conditions. Specific examples of the flow improver include silane coupling agents, silylating agents, fluorinated alkyl group-containing silane coupling agents, organic titanate-based coupling agents, aluminum-based coupling agents, silicone oils, and modified-silicone oils.

When the above cleaning improver is added in the toner, removal of the developer remained on the photoconductor and first transfer medium after transfer is facilitated. Specific examples of the cleaning improver include fatty acid metal salts such as zinc steareate, calcium steareate and stearic acid, and resin particles obtained by soap-free emulsion polymerization, such as methyl polymethacrylate particles and polystyrene particles. The resin particles preferably have a narrow particle size distribution and preferably have a volume-average particle diameter of 0.01 μm to 1 μm.

The magnetic materials are not particularly limited and can be appropriately selected from those known in the art depending on the intended purpose; examples thereof include iron powder, magnetite, and ferrite, with white magnetic materials being preferable in view of color tone.

As the toner production method by polymerization, a method of producing toner base particles while producing an adhesive base material is described below. In this method, preparation of aqueous medium phase, preparation of toner material-containing liquid, emulsification or dispersing of toner material, production of adhesive base material, solvent removal, synthesis of a polymer reactive with active hydrogen group, synthesis of an active hydrogen group-containing compound, etc., are carried out.

Preparation of the Aqueous Medium Phase can be Achieved by dispersing resin particles into an aqueous medium. The added amount of the resin particles in the aqueous medium is preferably 0.5% by mass to 10% by mass.

Preparation of the Toner Material-Containing Liquid (Toner solution) can be achieved by dissolving and/or dispersing in a solvent a toner material containing an active hydrogen group-containing compound, polymer reactive with an active hydrogen group, a laminar inorganic mineral at least partially modified with an organic anion, colorant, pigment, releasing agent, charge control agent, unmodified polyester resin, etc.

In the toner material ingredients except for the polymer reactive with an active hydrogen group may be added in the aqueous medium upon dispersing of fine resin particles in the aqueous medium, or may be added in the aqueous medium upon addition of the toner solution in the aqueous medium.

Emulsification or dispersing of the toner material can be achieved by dispersing of the toner solution in the aqueous medium. By allowing the active hydrogen group-containing compound and polymer reactive with an active hydrogen group to undergo elongation reaction and/or crosslinking reaction upon emulsification or dispersing of the toner material, an adhesive base material is produced.

The adhesive base material (e.g., urea-modified polyester resin) may be produced by emulsifying or dispersing in an aqueous medium a solution containing a polymer reactive an active hydrogen group (e.g., isocyanate group-containing polyester prepolymer) together with an active hydrogen group-containing compound (e.g., amine) so that they undergo elongation reaction and/or crosslinking reaction in the aqueous medium, may be produced by emulsifying or dispersing the toner solution in an aqueous medium in which an active hydrogen group-containing compound has been previously added so that they undergo elongation reaction and/or crosslinking reaction in the aqueous medium, or may be produced by emulsifying or dispersing the toner solution in an aqueous medium and adding an active hydrogen group-containing compound so that they undergo elongation reaction and/or crosslinking reaction from particle interfaces in the aqueous medium. When effecting the elongation reaction and/or crosslinking reaction from particle interfaces, formation of urea-modified polyester resin is favored on the toner particle surfaces being produced; thus it is possible to form a concentration gradient of urea-modified polyester resin in the toner particles.

The reaction conditions used for the production of the adhesive base material is not particularly limited and can be appropriately determined depending on the combinations of the polymer reactive with an active hydrogen group and active hydrogen group-containing compound. A suitable reaction time is preferably from 10 minutes to 40 hours, more preferably from 2 hours to 24 hours. A suitable reaction temperature is preferably from 0° C. to 150° C., more preferably from 40° C. to 98° C.

A suitable method of stably forming a dispersion liquid containing a polymer reactive with an active hydrogen group (e.g. isocyanate group-containing polyester prepolymer is, for example, a method in which a toner solution, prepared by dissolving or dispersing in a solvent a toner material containing the polymer reactive with an active hydrogen group, colorant, releasing agent, charge control agent, unmodified polyester resin, etc., is added in an aqueous medium phase and dispersed by shear force.

The dispersing can be achieved using conventionally known dispersers; examples thereof include a low-speed shear disperser, high-speed shear disperser, friction disperser, high-pressure and jet disperser, supersonic disperser. Among these, the high-speed shear disperser is preferable, because it is capable of adjusting the particle diameter of the dispersant to be within a range of 2 μm to 20 μm.

When the high-speed shear disperser is used, conditions such as a rotational speed, dispersing time, dispersing temperature, etc., can be determined depending on the intended purpose. The rotational speed is preferably 1,000 rpm to 30,000 rpm, more preferably 5,000 rpm to 20,000 rpm. The dispersing time is preferably 0.1 minutes to 5 minutes in the case of batch method. The dispersing temperature is preferably 0° C. to 150° C., more preferably 40° C. to 98° C. under pressure. In general, dispersing can be more easily effected at higher temperatures.

The amount of the aqueous medium for emulsification or dispersing of the toner material is preferably 50 parts by mass to 2,000 parts by mass, more preferably 100 parts by mass to 1,000 parts by mass relative to 100 parts by mass of the toner material. When the amount of the aqueous medium is less than 50 parts by mass, it may result in poor dispersing of toner material and thus toner base particles with a desired particle diameter cannot be obtained. When the amount of the aqueous medium is greater than 2,000 parts by mass, it may result in high production costs.

The step of emulsifying or dispersing the toner solution preferably employs a dispersant for the purpose of stabilizing the dispersion such as oil droplets to achieve a desired shape, and making the particle size distribution sharp.

The dispersant can be appropriately selected depending on the intended purpose; examples thereof include surfactants, poor water-soluble inorganic dispersants, and polymeric protective colloids, with surfactants being preferable. These dispersants may be used alone or in combination.

Examples of the surfactants include anionic surfactants, cationic surfactants, nonionic surfactants, and ampholytic surfactants.

Examples of the anionic surfactants include alkylbenzene sulfonates, α-olefin sulfonates, and phosphates. Among these, those having fluoroalkyl groups are preferable. Examples of the fluoroalkyl group-containing anionic surfactants include fluoroalkyl carboxylic acids having 2 to 10 carbon atoms or metal salts thereof, disodium perfluorooctanesulfonylglutamate, sodium-3-(omega-fluoroalkyl ($C_6$-$C_{11}$)oxy)-1-alkyl($C_3$-$C_4$) sulfonate, sodium-3-(omega-fluoroalkanoyl($C_6$-$C_8$)—N-ethylamino)-1-propanesulfonate, fluoroalkyl($C_{11}$-$C_{20}$) carboxylic acids or metal salts thereof, perfluoroalkyl($C_7$-$C_{13}$) carboxylic acids or metal salts thereof, perfluoroalkyl($C_4$-$C_{12}$) sulfonic acids or metal salts thereof, perfluorooctanesulfonic acid diethanol amide, N-propyl-N-(2-hydroxyethyl)perfluorooctanesulfone amide, perfluoroalkyl($C_6$-$C_{10}$)sulfoneamidepropyltrimethylammonium salts, salts of perfluoroalkyl ($C_6$-$C_{10}$)—N-ethylsulfonyl glycin, and monoperfluoroalkyl($C_6$-$C_{16}$)ethylphosphoric acid esters. Examples of commercially available products of the fluoroalkyl group-containing surfactants include SURFLON S-111, S-112 and S-113 (manufactured by Asahi Glass Co.); FLORARD FC-93, FC-95, FC-98 and FC-129 (manufactured by Sumitomo 3M Ltd.); UNIDYNE DS-101 and DS-102 (manufactured by Daikin Industries, Ltd.); MEGAFAC F-110, F-120, F-113, F-191, F-812 and F-833 (manufactured by Dainippon Ink and Chemicals, Inc.); EFTOP EF-102, 103, 104, 105, 112, 123A, 123B, 306A, 501, 201 and 204 (manufactured by Tohchem Products Co.); and FTERGENT F-100 and F150 (by Neos Co.).

Examples of the cationic surfactants include amine salts such as alkyl amine salts, amino alcohol fatty acid derivatives, polyamine fatty acid derivatives, and imidazoline; and quaternary ammonium salts such as alkyltrimethyl ammonium salts, dialkyldimethyl ammonium salts, alkyldimethyl benzyl ammonium salts, pyridinium salts, alkyl isoquinolinium salts, and benzethonium chloride. Among these, preferable examples are primary, secondary or tertiary fluoroalkyl group-containing aliphatic amine acids, aliphatic quaternary ammonium salts such as perfluoroalkyl($C_6$-$C_{10}$)sulfoneamidepropyltrimethylammonium salts, benzalkonium salts, benzetonium chloride, pyridinium salts, and imidazolinium salt. Specific examples of the commercially available products thereof include SURFLON S-121 (by Asahi Glass Co.), FLORARD FC-135 (manufactured by Sumitomo 3M Ltd.), UNIDYNE DS-202 (manufactured by Daikin Industries, Ltd.), MEGAFAC F-150 and F-824 (manufactured by Dainippon Ink and Chemicals, Inc.), EFTOP EF-132 (manufactured by Tohchem Products Co.), and FTERGENT F-300 (manufactured by Neos Co.).

Examples of the nonionic surfactants include fatty acid amide derivatives, and polyhydric alcohol derivatives.

Examples of the ampholytic surfactants include alanine, dodecyldi(aminoethyl)glycin, di(octylaminoethyl)glycin, and N-alkyl-N,N-dimethylammonium betaine.

Examples of the poor water-soluble inorganic dispersants include tricalcium phosphate, calcium carbonate, titanium oxide, colloidal silica, and hydroxyl apatite.

Examples of the polymeric protective colloids include homopolymers or copolymers prepared by polymerization of a carboxyl group-containing monomer, hydroxyl group-containing alkyl(meth)acrylate, vinyl ether, vinyl carboxylate, amide monomer, acid chloride monomer, or monomer containing a nitrogen atom or heterocyclic ring thereof, polyoxyethylene resins; and celluloses. The homopolymers or copolymers obtained by polymerization of any of the above monomers encompass those having vinyl alcohol-derived units.

Examples of the carboxyl group-containing monomer include acrylic acid, methacrylic acid, α-cyanoacrylic acid, α-cyanomethacrylic acid, itaconic acid, crotonic acid, fumaric acid, maleic acid, and maleic anhydride. Examples of the hydroxyl group-containing alkyl(meth)acrylate monomer include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethyleneglycol monomethacrylate, glycerin monoacrylate, and glycerin monomethacrylate. Specific examples of the vinyl ether include vinyl methyl ether, vinyl ethyl ether, and vinyl propyl ether. Examples of vinyl carboxylate include vinyl acetate, vinyl propionate, and vinyl butyrate. Examples of the amide monomer include acrylamide, methacrylamide, diacetone acrylicamide, N-methylolacrylamide, N-methylolmethacrylamide. Examples of the acid chloride include acrylic chloride, and methacrylic chloride. Examples of the homopolymers having a nitrogen atom or heterocyclic ring thereof include vinyl pyridine, vinyl pyrrolidone, vinyl imidazole, and ethyleneimine. Examples of the polyoxyethylene resins include polyoxyethylene, polyoxypropylene, polyoxyethylene alkylamines, polyoxypropylene alkylamines, polyoxyethylene alkylamides, polyoxypropylene alkylamides, polyoxyethylene nonylphenylether, polyoxyethylene laurylphenylether, polyoxyethylene phenyl stearate, and polyoxyethylene phenyl pelargonate. Examples of the celluloses include methyl cellulose, hydroxyethyl cellulose, and hydroxypropyl cellulose.

Upon emulsification or dispersing of the toner material a dispersant is used as needed. Examples of the dispersant include those capable of being dissolved in acid or alkali, such as calcium phosphate. When calcium phosphate is employed as the dispersant, it can be removed by dissolving it in hydrochloric acid or the like and followed by washing with water, or by enzymatic decomposition.

The elongation reaction and/or crosslinking reaction for production of adhesive base material can employ a catalyst; examples thereof include dibutyltin laurate, and dioctyltin laurate.

The removal of the organic solvent from the obtained dispersion liquid such as emulsified slurry is carried out, for example, by any of the following methods: a method in which the temperature of the whole reaction system is gradually increased so as to evaporate the organic solvent in the oil droplets; and a method in which the dispersion liquid is sprayed in a dry atmosphere so as to remove the organic solvent from the oil droplets.

Once the organic solvent has been removed, toner base particles are formed. The toner base particles may be washed and dried, and where necessary, can be classified. The classification is, for example, carried out using a cyclone, decanter, or centrifugal separation in the solution for removal of fine particles. Alternatively, the classification is carried out after the toner particles have been dried.

The thus obtained toner base particles may be mixed with particles of such agents as a colorant, releasing agent, charge control agent, and the like. At this time, mechanical impact may be applied to the toner particles so as to prevent the particles of releasing agent, etc., from being come off from the toner base particle surface.

Examples of the method of application of mechanical impact include a method in which impact is applied by rotating a blade at high speeds, and a method in which impact is applied by putting mixed particles into a high-speed air flow and accelerating the air speed such that the particles collide with one another or that the particles are crashed into a proper collision plate. Examples of the device employing this method include an Angmill (manufactured by Hosokawamicron Corp.), a modified I-type mill (manufactured by Nippon Pneumatic Mfg. Co., Ltd.) to decrease pulverization air pressure, a hybridization system (manufactured by Nara Machinery Co., Ltd.), a kryptron system (manufactured by Kawasaki Heavy Industries, Ltd.), and an automatic mortar.

A toner of the present invention is produced by a method for producing a toner for image formation of the present invention.

Since the toner of the present invention has a smooth surface, it is excellent in various characteristics such as transferability and charging ability and can form high quality images. Besides, when the toner of the present invention contains an adhesive base material which is obtained by reacting an active hydrogen-containing compound and a polymer having reactivity to the active hydrogen group in an aqueous medium, the toner is further excellent in various characteristics such as transferability and fixing properties. Furthermore, the toner is excellent in storage stability and offset resistance by adjusting the glass transition temperature of the mixture of a pigment dispersant and a binder resin and the glass transition temperature of the binder resin within a specific range and adjusting the melting point of the pigment dispersant within a specific range. On this account, the toner of the present invention can be used in various fields and the toner is suitable for use in image forming by electrophotography.

The volume-average particle diameter of the toner of the present invention is preferably 3 μm to 8 μm, more preferably 4 μm to 7 μm. When the volume-average particle diameter is less than 3 μm, in the case of two-component developer, toner adhered to the carrier surface occurs during long term stirring in the development device, which may reduce the charging ability of carrier, and in the case of one-component developer, toner filming to the development roller or toner adhesion to members (e.g., blade to form a thin toner film) occurs. When the volume-average particle diameter is greater than 8 μm or more, it becomes difficult to obtain high-resolution, high-quality images, and variations in toner particle diameter may increase after toner consumption or toner supply in the developer.

The ratio of the volume-average particle diameter to the number-average particle diameter of the toner of the present invention is preferably 1.00 to 1.25, more preferably 1.05 to 1.25. When this ratio falls within this range, in the case of the two-component developer, variations in toner particle diameter are small in the developer even after toner consumption and toner supply have been repeated for a long time, and in addition, even after a long time stirring in the development device, excellent and stable developing ability can be ensured. Moreover, when this requirement is met in the case of the one-component developer, variations in toner particle diameter decrease even after toner consumption or toner supply, and toner filming to the development roller and toner adhesion to members (e.g., blade to form a thin toner film) are prevented, and in addition, even after long-time use of the development device, i.e., long-time stirring of developer, excellent developing ability can be ensured. Thus, high-quality images can be obtained. When the above ratio is greater than 1.25, it becomes difficult to obtain high-resolution, high-quality images, and variations in toner particle diameter may increase after toner consumption or toner supply in the developer.

The ratio of the volume-average particle diameter to the number-average particle diameter of the toner of the present invention can be determined as follows with MULTISIZER III, a particle size analyzer manufactured by Beckman Coulter, Inc. At first, to 100 ml to 150 ml of an aqueous electrolyte solution (e.g., aqueous solution of sodium chloride (approximately 1 mass %)) is added 0.1 ml to 5 ml of surfactant, e.g. alkylbenzene sulfonate, as a dispersant. Subsequently, 2 mg to 20 mg of a sample is added to the aqueous electrolyte solution. The aqueous electrolyte solution with suspended sample is then dispersed for approximately 1 min to 3 min with an ultrasonic disperser, and the volumes and numbers of toner particles are measured using a 100 μm-aperture to obtain a volume distribution and a number distribution. The volume-average particle diameter and number-average particle of toner can be found using these distributions.

The penetration of toner of the present invention is preferably 15 mm or more, more preferably 20 mm to 30 mm. When the penetration is less than 15 mm, it may result in poor heat resistant storage stability. The penetration can be measured with a penetration test in accordance with JIS K2235-1991. More specifically, a 50-ml glass container is filled with toner and placed in a constant-temperature bath at 50° C. for 20 hours, and the toner is cooled to room temperature for penetration test. Note that greater values of penetration indicate higher heat resistant storage stability.

The toner of the present invention preferably has a low minimum fixing temperature and a high offset-free temperature for the purpose of ensuring both low-temperature fixing ability and offset resistance. To achieve this it is preferable that the minimum fixing temperature be less than 140° C. and that the offset-free temperature be 200° C. or more. As used herein, "minimum fixing temperature" means a lower limit of the fixing temperature at which 70% or more of image density remains after scrubbing the obtained image with a pad. As used herein, "offset-free temperature" means a temperature where no offset occurs and can be measured using an image forming apparatus designed such that development is effected using a given amount of toner.

The thermal characteristics of the toner of the present invention are also referred to as flow tester characteristics and evaluated in terms of softening point, flow start temperature, and softening point as measured by ½ method. These parameters can be measured with an appropriately selected method; for example, Flow Tester CFT500, an elevation-type flow tester manufactured by Shimadzu Corporation can be employed.

The softening point of the toner of the present invention is preferably 30° C. or more, more preferably 50° C. to 90° C. When the softening point is less than 30° C., it may result in poor heat resistant storage stability.

The flow start temperature of the toner of the present invention is preferably 60° C. or more, more preferably 80° C. to 120° C. When the flow start temperature is less than 60° C., at least one of heat resistant storage stability and offset resistance may decrease.

The softening point of the toner of the present invention, as measured by ½ method, is preferably 90° C. or more, more preferably 100° C. to 170° C. When the softening point as measured by ½ method is less than 90° C., it may result in poor offset resistance.

The glass transition temperature of the toner of the present invention is preferably 40° C. to 70° C., more preferably 45° C. to 65° C. When the glass transition temperature is less than 40° C. or less, it may result in poor heat resistant storage stability. When the glass transition temperature is greater than 70° C. or less, it may result in insufficient low-temperature fixing ability. The glass transition temperature can be measured for instance with DSC-60, a differential scanning calorimeter manufactured by Shimadzu Corporation.

The adhesive base material described above as a binder resin has a glass transition temperature of 40° C. to 65° C., and when mixed with a pigment and a pigment dispersant, it may react with the pigment or so and may increase the glass transition temperature.

However, decrease in heat resistant storage stability and offset resistance can be suppressed by adjusting the glass transition temperature of the adhesive base material which is the main constituting materials of the toner within the range of 40° C. to 65° C.

The image density of an image formed using the toner of the present invention is preferably 1.40 or more, more preferably 1.45 or more, and still more preferably 1.50 or more. When the image density is less than 1.40, the image density is so low that it may result in failure to obtain high-quality images. The image density can be found in the following manner. Using a tandem color image forming apparatus (IMAGIO NEO 450, manufactured by Ricoh Company, Ltd.), a solid image with a deposition amount of a developer of 1.00±0.1 mg/cm$^2$ is printed onto copy paper (type 6200, manufactured by Ricoh Company, Ltd.) while setting the surface temperature of the fixing roller to 160° C.±2° C. Thereafter, the image densities of any given five points of the solid image are measured with X-Rite 938 Spectrodensitometer and averaged. In this way the average value is taken as the above image density.

The color of the toner of the present invention can be appropriately selected depending on the intended purpose. It may be at least one selected from a group consisting of a black toner, cyan toner, magenta toner and yellow toner. The toner of each color can be obtained by appropriately selecting a colorant.

A developer of the present invention contains a toner of the present invention and may further contains additional ingredients such as carrier selected appropriately. Thus, the developer has excellent transferability, charging ability and is capable of stable formation of high-quality images. The developer may be a one-component developer or two-component developer and it is preferably a two-component developer for its long life when used in high-speed printers supporting for recent high information processing speed.

When the developer of the present invention is used as a one-component developer, variations in toner particle diameter decrease even after toner consumption or toner supply, and toner filming to the development roller and toner adhesion to members (e.g., blade to form a thin toner film) are prevented, and in addition, even after long-time use of the development device (i.e., long-time stirring of developer), excellent developing ability can be ensured.

When the developer of the present invention is used as a two-component developer, even after a long-time toner consumption and toner supply, variations in toner particle diameter are small, and even after long-time stirring in the development device, excellent and stable developing ability can be ensured to obtain an excellent and stable image.

The carrier can be selected appropriately depending on the intended purpose and it is preferably a carrier composed of a core material and a resin layer covering the core material.

The material of the core material is not particularly limited and can be selected from those known in the art. For example, it is preferable to employ manganese-strontium (Mn—Sr) material or manganese-magnesium (Mn—Mg) material (50 emu/g to 90 emu/g), preferably high magnetization material such as iron powder (100 emu/g or more) or magnetite (75 emu/g to 120 emu/g) for the purpose of securing image density. Moreover, it is preferably a low magnetization material such as copper-zinc (Cu—Zn) with 30 emu/g to 80 emu/g because the impact toward the photoconductor having a developer in the form of magnetic brush can be relieved and because it is advantageous for higher image quality. These materials may be used alone or in combination.

The volume-average particle diameter of the core material is preferably 10 μm to 150 μm, more preferably 40 μm to 100 μm. When the volume-average particle diameter is less than 10 μm, the amount of fine carrier powder increases, whereas magnetization per particle decreases and carrier scattering may occur. When the volume-average particle diameter is greater than 150 μm, the specific surface area decreases and thus toner scattering may occur; therefore, in the case of printing a full-color image composed with many solid portions, especially the reproduction of the solid portions may become insufficient.

The material of the resin layer is not particularly limited and can be appropriately selected from conventionally known resins depending on the intended purpose. Examples include amino resins, polyvinyl resins, polystyrene resins, halogenated polyolefins, polyester resins, polycarbonate resins, polyethylene, polyvinyl fluoride, polyvinylidene fluoride, polytrifluoroethylene, polyhexafluoropropylene, copolymers of vinylidene fluoride and acrylic monomer, copolymers of vinylidene fluoride and vinyl fluoride, fluoroterpolymers such as terpolymers of tetrafluoroethylene, vinylidene fluoride and non-fluoro monomer, and silicone resins. These may be used alone or in combination.

Examples of the amino resins include urea-formaldehyde resins, melamine resins, benzoguanamine resins, urea resins, polyamide resins, and epoxy resins. Examples of the polyvinyl resins include acrylic resins, polymethylmetacrylate, polyacrylonitrile, polyvinyl acetate, polyvinyl alcohol, and polyvinyl butyral. Specific examples of the polystyrene resins include polystyrene and styrene-acrylic copolymers. Examples of the halogenated polyolefins include polyvinyl chloride. Examples of the polyester resins include polyethyleneterephtalate and polybutyleneterephtalate.

The resin layer may contain conductive powder or the like as necessary; examples of the conductive powder include metal powder, carbon black, titanic oxide, tin oxide, and zinc oxide. The average particle diameter of these conductive powders is preferably 1 μm or less. If the average particle diameter is greater than 1 μm, it may be difficult to control the electrical resistance.

The resin layer may be formed by uniformly coating a surface of the core material with a coating solution which is obtained by dissolving a silicone resin or the like in a solvent, by conventionally known coating method, followed by drying and baking. Examples of the coating method include dipping, spraying, and brushing. The solvent is not particularly limited and can be appropriately selected depending on the intended purpose; examples thereof include toluene, xylene, methyl ethyl ketone, methyl isobutyl ketone, and butyl cellosolve acetate. The baking is not particularly limited and can be external heating or internal heating and examples of baking methods include methods using fixed electric furnace, fluid electric furnace, rotary electric furnace, or burner furnace, and methods using microwaves.

The amount of the resin layer in the carrier is preferably 0.01% by mass to 5.0% by mass. When the amount is less than 0.01% by mass, it may result in failure to uniformly form the resin layer over the surface of the core material. When the amount is more than 5.0% by mass, the resin layer becomes so thick that adhesion of carrier particles occurs and thus equally-sized carrier particles may less obtained.

The carrier content in the two-component developer is preferably 90% by mass to 98% by mass, more preferably 93% by mass to 97% by mass.

The developer of the present invention can be used in a variety of image formation methods using conventionally known electrophotographic methods, such as magnetic one-component developing method, non-magnetic one-component developing method, or two-component developing method.

A toner container in the present invention contains therein the toner of the present invention, and encompasses a toner container containing the developer of the present invention.

The container for the toner container can be appropriately selected from those known in the art. Preferable examples thereof include those having a toner container body and a cap.

The size, shape, structure, material, etc., of the toner container body can be appropriately determined depending on the intended purpose. The shape is preferably a cylindrical shape, for example. It is particularly preferable that a spiral ridge be formed on the inner surface, wherein the spiral partly or entirely serves as a bellow; thereby the content or toner moves toward the discharging port when rotated.

The material of the toner container body is preferably made of material that offers good dimensional accuracy. For example, polyester resins, polyethylene, polypropylene, polystyrene, polyvinyl chloride, polyacrylic acid, polycarbonate resins, ABS resins, polyacetal resins are preferable.

The toner container is easy to be stored and delivered and has excellent handleability, and is preferably used with a process cartridge or an image forming apparatus by being detachably mounting thereto for toner supply.

A process cartridge of the present invention includes at least a latent electrostatic image bearing member, and a developing unit containing the developer of the present invention, and where necessary, may further includes other units, as necessary.

Thus, a latent electrostatic image on the latent electrostatic image bearing member is developed using the developer so as to form a visible image.

The developing unit includes at least a toner container, a developer bearing member configured to bear and transfer the developer, and further includes a layer thickness control member for controlling the thickness of toner layer borne on the developer bearing member.

The process cartridge of the present invention can be detachably mounted to the image forming apparatus.

An image is formed using the developer of the present invention by the image forming method of the present invention. Therefore, high image quality can be efficiently obtained.

An image forming method of the present invention includes at least a latent electrostatic image forming step, a developing step, a transferring step and a fixing step, and further includes additional steps such as a charge eliminating step, a cleaning step, a recycling step, and a controlling step, as necessary.

An image forming apparatus using the developer of the present invention includes at least a latent electrostatic image bearing member, a latent electrostatic image forming unit, a developing unit containing the developer of the present invention, a transfer unit and a fixing unit, and further includes additional units such as a charge eliminating unit, a cleaning unit, a recycling unit, and a controlling unit, as necessary.

An image forming apparatus using a developer containing the toner of the present invention is described below.

FIG. 1 is a schematic view showing the configuration of one embodiment according to an image forming apparatus of the present invention. In FIG. 1 reference numeral 100 denotes a copier main body, 200 denotes a paper feed table for supporting the copier main body 100, 300 denotes a scanner mounted on the copier main body 100, and 400 denotes an automatic document feeder (ADF) mounted on the scanner.

The copier main body 100 is provided with a tandem image forming apparatus 20 in which four image forming units 18 are linearly arranged, each having electrophotography process units (e.g., a charging unit, a developing unit, and cleaning unit) around a photoconductor 40, as a latent electrostatic image bearing member. Above the tandem image forming apparatus 20, there is provided an exposure device 21 configured to expose the photoconductor 40 using a laser beam based on the image information so as to form a latent image. An intermediate transfer belt 10 formed of an endless belt member is arranged at a position facing the photoconductors 40 of the tandem image forming apparatus 20. Primary transfer units 62, which transfer respective toner images with different colors formed on their corresponding photoconductors 40 to intermediate transfer belt 10, are provided across the intermediate transfer belt 10 from the photoconductors 40.

Below the intermediate transfer belt 10 there is provided a secondary transfer device 22 that transfer the toner images, superimposed on the intermediate transfer belt 10, to a transfer sheet at a time that is delivered from the paper feed table 200. The secondary transfer device 22 is composed of a secondary transfer belt 24 (endless belt) stretched between two rollers 23 and is pressed against a supporting roller 16, with the intermediate transfer belt 10 placed between them. With this configuration the toner image on the intermediate transfer belt 10 is transferred onto a transfer paper sheet. Beside the secondary transfer device 22, there is provide a fixing device 25 that fixes the image to the transfer paper sheet. The fixing device 25 includes a press roller 252 pressed against a fixing belt 254 which is an endless belt.

The secondary transfer device 22 also has a sheet transfer function of transferring a transfer paper sheet, on which an image has been transferred, to the fixing device 25.

In FIG. 1, below the secondary transfer device 22 and fixing device 25 and parallel to the tandem image forming apparatus 20, there is provided a reversing device 28 that flips over the transfer sheet for both-side printing.

The developing device of the image forming unit 18 employs a developer containing the above toner. In the developing device a developer bearing member bears thereon the developer for delivery, and an alternating electric field is applied at a position facing the photoconductor 40 so as to develop a latent image formed thereon. Application of an alternating electric field activates the developer and thereby a narrower toner charge amount distribution can be obtained, increasing the developing ability.

In addition, it is possible to employ a process cartridge in which the photoconductor 40 and developing device are integrated together, which process cartridge being configured such that it is detachably mounted to the image forming apparatus main body. The process cartridge may further include a charging unit, and a cleaning unit.

Figure 2:
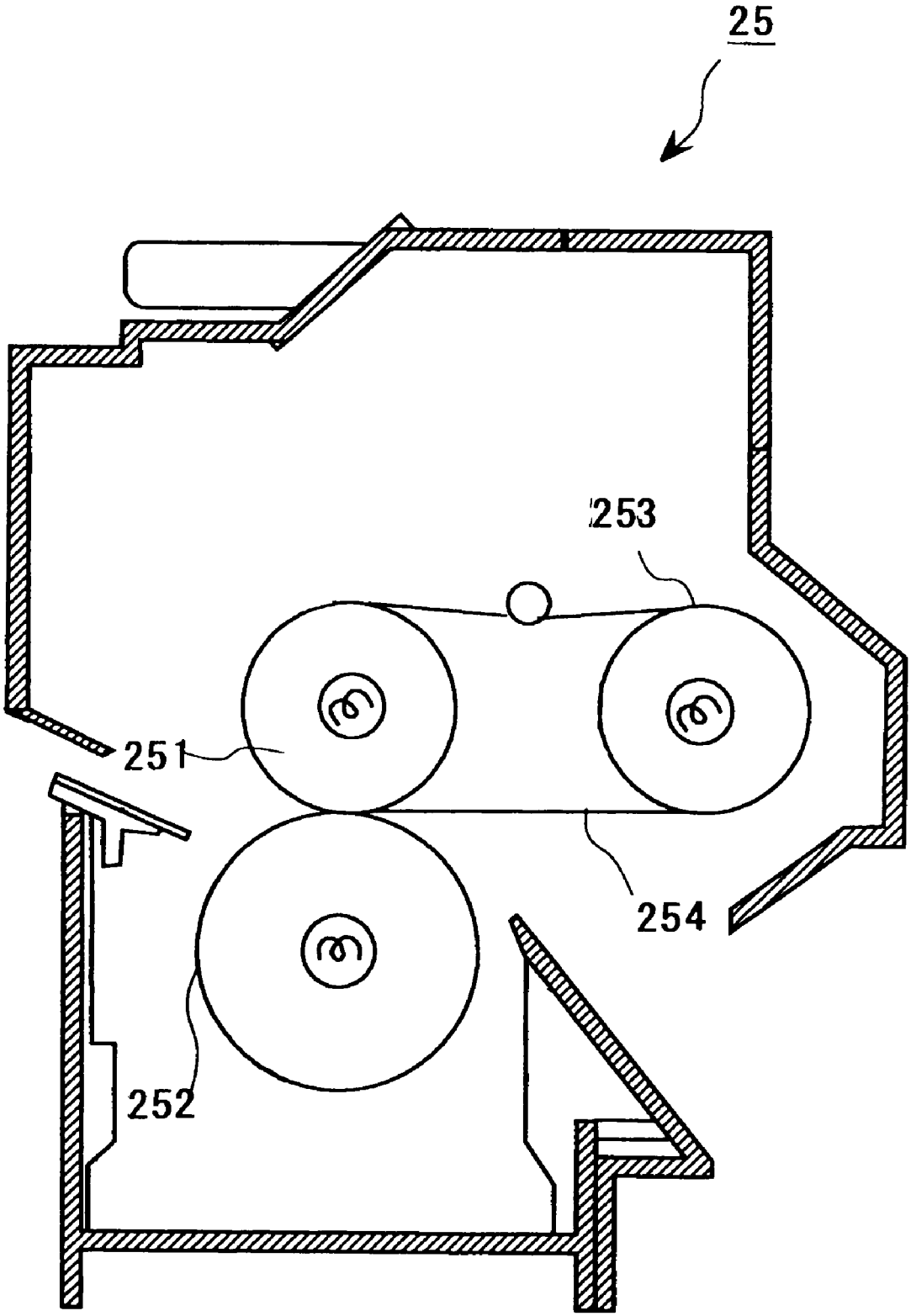
FIG. 2 is a schematic illustration view showing an example of a fixing device used for an image forming apparatus used in the present invention.

FIG. 2 is a schematic view showing one embodiment of a fixing device according to the present invention, with a fixing belt is mounted thereto. The fixing device 25 includes a pressing roller 253, a fixing roller 251, a heating roller 252 as a pressing means that is pressed against the fixing roller 251, and a fixing belt 254 stretched between the heating roller 253 and fixing roller 251. The pressing roller 252 is biased by a pressing member such as a spring (not shown) toward the fixing roller 251, deforming the elastic layer to form a nip portion between the fixing roller 251 and pressing roller 252, where toner is pressed and heated for a given time.

As a base of the fixing belt 254, an endless belt-shaped base made of heat-resistant resin or metal is used. As the heat-resistant resin for example, polyimide, polyamideimide, and polyether ether ketone are conventionally known. As the metal, for example, nickel, aluminum, and stainless steel are used. The resin and metal may be formed in layers. In particular, a belt composed of polyimide resin and electroformed nickel is preferable because it has high strength, elasticity, and durability. Preferably, the thickness is 100 μm or less. In order for the fixing belt 254 to be in press-contact with a transfer paper sheet and toner, the fixing belt 254 is composed of an elastic layer made of silicone rubber or the like that offers high releasing ability and of a heat-resistant releasing layer made of fluorine resin with a low friction coefficient.

The heating roller 253 is a member for stretching and heating the fixing belt 254 stretched around it. To achieve the heating roller 253 includes therein a heat source such as a halogen lamp or a nichrome wire.

There is provided a temperature sensor 258 composed of a thermo couple, thermistor or the like at a position across the fixing belt 254 from the heating roller 253 for the purpose of measuring the temperature of the circumferential surface of the fixing belt 254. In accordance with detection signals received from the temperature sensor, a temperature controller (not shown) controls the operation of the heater or the like in the heating roller 253.

The above-described image forming apparatus operates as follows.

At first, a document is placed on a document table 30 of an automatic document feeder (ADF) 400. Alternatively, the automatic document feeder 400 is opened, the document is placed onto a contact glass 32 of a scanner 300, and the automatic document feeder 400 is closed.

When a start switch (not shown) is pushed, a document, if any, placed on the automatic document feeder 400 is transferred onto the contact glass 32. When the document is initially placed on the contact glass 32, the scanner 300 is immediately driven to operate a first carriage 33 and a second carriage 34. At the first carriage 33, light is applied from a light source to the document, and reflected light from the document is further reflected toward the second carriage 34. The reflected light is further reflected by a mirror of the second carriage 34 and passes through image-forming lens 35 into a read sensor 36 to thereby read the document.

When the start switch is pushed, a drive motor (not shown) drives one of support rollers 14, 15 and 16 to rotate, causing the other two support rollers to rotate by the rotation of the driven support roller. In this way the intermediate transferring member 10 endlessly runs around the support rollers 14, 15 and 16. Simultaneously, the individual image forming units 18 respectively rotate their photoconductors 40 to thereby form black, yellow, magenta, and cyan monochrome images on the photoconductors 40, respectively. With the conveying intermediate transferring member 10, the monochrome images are sequentially transferred to form a composite color image on the intermediate transfer 10.

Separately, when the start switch is pushed, one of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copier main body 100 and are bumped against a resist roller 49.

Alternatively, pushing the start switch rotates a feeder roller 50 to eject sheets on a manual bypass tray 51, the sheets are separated one by one on a separation roller 52 into a manual bypass feeder path 53 and are bumped against the resist roller 49.

The resist roller 49 is rotated synchronously with the movement of the composite color image on the intermediate transferring member 10 to transport the sheet into between the intermediate transferring member 10 and the secondary transferring unit 22, and the composite color image is transferred onto the sheet by action of the secondary transferring unit 22 to thereby record a color image.

The sheet bearing the transferred image is transported by the secondary transferring unit 22 into the fixing unit 25, is given heat and pressure in the fixing unit 25 to fix the transferred image, changes its direction by action of a switch blade 55, and is ejected by an ejecting roller 56 to be stacked on an output tray 57. After image transfer, an intermediate transfer cleaning device 17 removes residual toner particles on the intermediate transferring member 10 for another image formation by the tandem image forming apparatus 20.

Furthermore, other steps as described below may be provided. The charge eliminating step is a step of applying a charge-eliminating bias to the charged photoconductor for charge removal. This is suitably performed by the charge eliminating unit. The charge eliminating unit is not particularly limited, and can be appropriately selected from conventionally known charge eliminating devices depending on the intended purpose. A suitable example thereof is a charge eliminating lamp.

The cleaning step is a step of removing residual toner particles on the photoconductor. This is suitably performed by means of the cleaning unit. The cleaning unit is not particularly limited, and can be appropriately selected from conventionally known cleaners depending on the intended purpose; examples thereof include a magnetic blush cleaner, an electrostatic brush cleaner, a magnetic roller cleaner, a blade cleaner, a blush cleaner, and a wave cleaner.

The recycling step is a step of recycling toner collected in the cleaning step to the developing unit. This is suitably performed by means of the recycling unit.

The recycling unit is not particularly limited and can be appropriately selected from conventionally known conveyance systems.

The controlling is a step of controlling each of the aforementioned steps. This is suitably performed by means of the control unit; examples thereof include devices such as sequencers, computers and the like.

EXAMPLES

In the following, examples of the present invention are described but the present invention is not limited to the following examples by any means. In the following embodiments, each "part" and "%" in each example is based on a mass standard and the "mol" means a molar ratio.

Synthesis Example 1

A 500 ml separable four-necked flask equipped with a stirrer, a dropping funnel, a reflux condenser, a gas inlet pipe and a thermometer was charged with 18 parts of dimethylol butanoic acid, 44 parts of N,N-bis(2-hydroxypropyl)aniline and 60 parts of methyl ethyl ketone, the inner atmosphere of the flask was substituted with dry nitrogen and the temperature was elevated to 80° C. while stirring. 62 parts of isophorone diisocyanate were added dropwise over ten minutes under stirring and reacted for 6 hours. The reaction product was cooled to 65° C. and 319 parts of water and 11 parts of 25% ammoniacal water were added thereto and 60 parts of methyl ethyl ketone and 330 parts of alkaline water, which were the solvents, were removed by elevating the temperature. As a result, Pigment dispersant A having an acid value of 31 and an amine value of 25 was obtained.

Here, the acid value (AV) and the hydroxyl value (OHV) in the present invention were specifically determined by the following procedure.

Measuring apparatus: Potential difference automatic titrator DL-53 Titrator (manufactured by Mettler-Toledo International Inc.)

Electrode used: DG113-SC (manufactured by Mettler-Toledo International Inc.)

Analyzing software: LabX Light Version 1.00.000

Calibration of apparatus: a mixed solvent of 120 ml of toluene and 30 ml of ethanol was used.

Measurement temperature: 23° C.

The measurement conditions are as follows.

| | |
|---|---|
| Stir | |
| Speed [%] | 25 |
| Time [s] | 15 |
| EQP titration | |
| Titrant/Sensor | |
| Titrant | $CH_3ONa$ |
| Concentration [mol/L] | 0.1 |
| Sensor | DG115 |
| Unit of measurement | mV |
| Predispensing to volume | |
| Volume [mL] | 1.0 |
| Wait time [s] | 0 |
| Titrant addition | Dynamic |
| dE(set) [mV] | 8.0 |
| dV(min) [mL] | 0.03 |
| dV(max) [mL] | 0.5 |
| Measure mode controlled | Equilibrium |
| dE [mV] | 0.5 |
| dt [s] | 1.0 |
| t(min) [s] | 2.0 |
| t(max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs n = 1 | Yes |
| comb. termination conditions | No |
| Evaluation | |
| Procedure | Standard |
| Potential 1 | No |
| Potential 2 | No |
| Stop for reevaluation | No |

(Method for Measuring Acid Value)

The measurement was performed in the manner as described in JISK0070-1992 under the following conditions.

Sample preparation: 0.5 g of a toner was added to 120 ml of toluene and stirred at room temperature (23° C.) for about ten hours to dissolve the toner. 30 ml of ethanol was further added to prepare a sample solution.

The measurement results were calculated by the apparatus mention mentioned above, which calculation was performed as follows specifically.

Titration with a N/10 caustic potash-alcohol solution standardized beforehand was performed and the acid value was determined from the used amount of the alcoholic potash liquid by the following calculation.

Acid value=KOH(number of ml)×*N*×56.1/sample mass (wherein N is the factor of N/10 KOH)

(Method for Measuring Amine Value)

Sample preparation: 1.0 g of a pigment dispersion was added to 50 ml of dimethyl formamide and stirred at room temperature (23° C.) for about ten hours to dissolve the pigment dispersant, thereby preparing a sample solution.

The measurement results were calculated by the apparatus mention mentioned above, which calculation was performed as follows specifically.

Titration with a 1/100N hydrochloric acid-alcohol solution standardized beforehand was performed and the amine value was determined from the used amount of the hydrochloric acid/alcohol liquid by the following calculation.

Amine value=0.561×(Dripped amount(number of ml))×*N*(a factor of the dripping liquid)/sample mass(number of g)

(Method for Measuring Hydroxyl Value)

0.5 g of a sample was precisely weighed in a 100 ml measuring flask and 5 ml of an acetylation reagent was precisely added thereto. This was then immersed and heated in a bath at the temperature of 100° C.±5° C. The flask was taken out from the bath one or 2 hours later and after standing to cool, water was added thereto and acetic anhydride was decomposed by shaking the flask. The flask was heated again in the bath for further ten minutes or more to complete the decomposition and after standing to cool, the wall of the flask was washed well with an organic solvent. This liquid was subjected to potentiometric titration with a N/2 potassium hydroxide ethyl alcohol solution using the above electrode with and the OH value was determined (in accordance with JISK0070-1966).

(Method for Measuring Softening Point of Releasing Agent)

The softening point Tm of the releasing agent was determined at the peak top which showed the maximum endotherm amount in the DSC curve in differential scanning type calorimetry (DSC). The measurement was performed with TA-60WS and DSC-60 manufactured by Shimadzu Corporation under the measurement conditions shown below.

Measurement Conditions

Sample container: Sample pan made of aluminum (with a lid)

Sample amount: 5 mg

Reference: Sample pan made of aluminum (Alumina 10 mg)

Atmosphere: Nitrogen (Flow rate 50 ml/min)

Temperature Conditions

Initial temperature: 20° C.

Temperature elevation rate: 10° C./min

Final temperature: 150° C.

Retention time: None

Temperature lowering rate: 10° C./min

Final temperature: 20° C.

Retention time: None

Temperature elevation rate: 10° C./min

Final temperature: 150° C.

The measured results were analyzed using the above-mentioned data analysis software (TA-60, version 1.52) available from Shimadzu Corporation.

The analysis was performed by appointing a range of ±5° C. around a point showing the maximum peak of DrDSC curve, which was the differential curve of the DSC curve in the second heating, and determining the peak temperature using a peak analysis function of the analysis software. Then, the maximum endotherm temperature of the DSC curve was determined in the range of the above peak temperature +5° C. and −5° C. in the DSC curve using a peak analysis function of the analysis software. The temperature shown here corresponded to Tm of the wax.

Synthesis Example 2

A 500 ml separable four-necked flask equipped with a stirrer, a dropping funnel, a reflux condenser, a gas inlet pipe and a thermometer was charged with 22 parts of dimethylol butanoic acid, 46 parts of N,N-bis(2-hydroxypropyl)aniline and 60 parts of methyl ethyl ketone, the inner atmosphere of the flask was substituted with dry nitrogen and the temperature was elevated to 80° C. while stirring. 62 parts of isophorone diisocyanate were added dropwise over ten minutes under stirring and reacted for 6 hours.

The reaction product was cooled to 65° C. and 319 parts of water and 11 parts of 25% ammoniacal water were added thereto and 60 parts of methyl ethyl ketone and 330 parts of alkaline water, which were the solvents, were removed by elevating the temperature. As a result, Pigment dispersant B having an acid value of 44 and an amine value of 28 was obtained.

Synthesis Example 3

A 500 ml separable four-necked flask equipped with a stirrer, a dropping funnel, a reflux condenser, a gas inlet pipe and a thermometer was charged with 19 parts of dimethylol butanoic acid, 6 parts of N,N-bis(2-hydroxypropyl)aniline, 60 parts of methyl ethyl ketone, the inside of the flask was substituted with dry nitrogen and the temperature was elevated to 80° C. while stirring. 62 parts of isophorone diisocyanate were added dropwise over ten minutes under stirring and reacted for 6 hours. The reaction product was cooled to 65° C. and 319 parts of water and 11 parts of 25% ammoniacal water were added thereto and 60 parts of methyl ethyl ketone and 330 parts of alkaline water, which were the solvents, were removed by elevating the temperature. As a result, Pigment dispersant C having an acid value of 33 and an amine value of 4 was obtained.

Synthesis Example 4

A 1,000 ml four-necked flask equipped with a reflux condenser, a dropping funnel, a gas inlet pipe, a stirrer and a thermometer was charged with 12 parts of polytetramethylene glycol having a hydroxyl value of 56 (average molecular mass: about 2,000), 21 parts of dimethylol butanoic acid, 30 parts of N,N-bis(2-hydroxypropyl)aniline, 60 parts of methyl ethyl ketone, the inner atmosphere of the flask was substituted with dry nitrogen and the temperature was elevated to 80° C. while stirring. 56.3 parts of isophorone diisocyanate were added dropwise over ten minutes under stirring and reacted for 6 hours. The reaction product was cooled to 65° C. and 320.2 parts of water and 9.8 parts of 25% ammoniacal water were added thereto and 60 parts of methyl ethyl ketone and 330 parts of alkaline water, which were the solvents, were removed by elevating the temperature. As a result, Pigment dispersant D having an acid value of 48 and an amine value of 45 was obtained.

Synthesis Example 5

A 1,000 ml four-necked flask equipped with a reflux condenser, a dropping funnel, a gas inlet pipe, a stirrer and a thermometer was charged with 12 parts of polytetramethylene glycol having a hydroxyl value of 56 (average molecular mass: about 2,000), 30 parts of dimethylol butanoic acid, 42 parts of N,N-bis(2-hydroxypropyl)aniline, 60 parts of methyl ethyl ketone, the inside of the flask was substituted with dry nitrogen and the temperature was elevated to 80° C. while stirring. 56.3 parts of isophorone diisocyanate were added dropwise over ten minutes under stirring and reacted for 6 hours. The reaction product was cooled to 65° C. and 320.2 parts of water and 9.8 parts of 25% ammoniacal water were added thereto and 60 parts of methyl ethyl ketone and 330 parts of alkaline water, which were the solvents, were removed by elevating the temperature. As a result, Pigment dispersant E having an acid value of 55 and an amine value of 58 was obtained.

Polymerization Example 1

Into a reaction tank equipped with a condenser, an stirrer and a nitrogen inlet pipe, were added 229 parts of 2 mol ethylene oxide adduct of bispenol A, 529 parts of 3 mol propione oxide adduct of bispenol A propione oxide, 208 parts of terephthalic acid, 46 parts of adipic acid and 2 parts of dibutyl tin oxide and the mixture was reacted at an ordinary pressure at 230° C. for 8 hours. Then, after the reaction was performed under reduced pressure of 10 mmHg to 15 mmHg for 5 hours, 44 parts of anhydrous trimellitic acid were added to the reaction tank and reacted at an ordinary pressure at 180° C. for 2 hours to synthesize Non-modified Polyester A.

The obtained Non-modified Polyester A has a number average molecular mass of 2,500, a mass average molecular mass of 6,700, a glass transition temperature of 44° C. and an acid value of 25 mgKOH/g.

(Measurement of Molecular Mass of Toner)

Gel permeation chromatography (GPC) measuring apparatus: GPC-8220GPC (manufactured by Tosoh Corporation)

Column: TSKgel SuperHZM-H 15 cm, of 3 consecutive (manufactured by Tosoh Corporation)

Temperature: 40° C.

Solvent: THF

Flow rate: 0.35 ml/min

Sample: 0.4 ml of 0.15% sample was injected.

Pretreatment of the sample: The toner was dissolved in tetrahydrofuran THF (a product containing a stabilizer and manufactured by Wako Pure Chemical Industries, Ltd.) in a ratio of 0.15% and then filtered with a 0.2 μm filter and the filtrate was used as a sample. 100 μl of the above THF sample solution was injected and measured. In the molecular mass measurement of the sample, the molecular mass distribution which the sample has was calculate from the relation of logarithmic values and the number of counts with reference to an analytical curve prepared for several kinds of monodisperse polystyrene standard samples. As standard polystyrene samples for preparing the analytical curve, ShowdexSTANDARD Std. Nos. S-7300, S-210, S-390, S-875, S-1980, S-10.9, S-629, S-3.0, S-0.580 manufactured by Showa Denko Corporation and toluene were used. An RI (refraction index) detector was used for a detector.

Polymerization Example 2

Into a reaction tank equipped with a condenser, an stirrer and a nitrogen inlet pipe, were added 189 parts of 2 mol ethylene oxide adduct of bispenol A, 579 parts of 3 mol propione oxide adduct of bispenol A, 228 parts of terephthalic acid, 38 parts of adipic acid and 2 parts of dibutyl tin oxide and the mixture was reacted at an ordinary pressure at 230° C. for 8 hours. Then, after the reaction was performed under reduced pressure of 10 mmHg to 15 mmHg for 5 hours, 44 parts of anhydrous trimellitic acid were added to the reaction tank and reacted at an ordinary pressure at 180° C. for 3 hours to synthesize Non-modified Polyester B.

The obtained Non-modified Polyester B had a number average molecular mass of 2,800, a mass average molecular mass of 6,600, a glass transition temperature of 61° C. and an acid value of 25 mgKOH/g.

Example 1

Preparation Example of Pigment Dispersion

A vessel with a stirring bar was charged with 250 parts of Non-modified Polyester A as binder resin A, 100 parts of Pigment dispersant A as a polymer pigment dispersant and 1,625 parts of ethyl acetate, and the mixture was stirred until the non-denatured polyester dissolved. Then, 250 parts of magenta pigment (269 Pigment Red manufactured by Dainichiseika Colour & Chemicals Mfg. Co., Ltd.) as a colorant were added into the vessel, and the mixture was stirred for one hour to obtain a pigment mixture solution.

The obtained pigment mixed solution was subjected to 5 passes of treatment with ULTRAVISCOMILL (manufactured by AIMEX CO., Ltd.), a beads mill, filled with 0.3 mm zirconia beads to 80% by volume under the conditions of liquid sending rate of 1 kg/hour and a disk rim speed of 8 m/second, and then a pigment dispersion was obtained.

(Preparation Example of Raw Materials Solution)

A reaction vessel with a stirring bar and a thermometer was charged with 378 of non-denatured Polyester Resin A, 110 parts of carnauba wax, 22 parts of salicylic acid metallic complex E-84 (manufactured by Orient Chemical Industries Corporation) and 947 parts of ethyl acetate, and the temperature was elevated to 80° C. under stirring. The temperature of the mixture was kept at 80° C. for 5 hours, cooled to 30° C. over one hour and thereby a raw materials solution was obtained.

The obtained mixture was transferred to the reaction vessel and subjected to 3 passes of treatment with ULTRAVISCOMILL (manufactured by AIMEX CO., Ltd.), a beads mill, filled with 0.5 mm zirconia beads to 80% by volume under the conditions of liquid sending rate of 1 kg/hour and a disk rim speed of 6 m/second, so as to disperse carnauba wax to obtain a wax dispersion.

Then, the wax dispersion and further 290 parts of the pigment dispersion were added to 1,324 parts of 65% ethyl acetate solution of Non-Modified Polyester A and stirred for 30 minutes with T. K. HOMO DISPER (manufactured by Primix Corporation), and a dispersion of toner constituting materials was obtained.

A reaction vessel with a condenser, a stirrer and a nitrogen introduction pipe was charged with 682 parts of 2 mol ethylene oxide of bispenol A, 81 parts of 2 mol propylene oxide adduct of bispenol A, 283 parts of terephthalic acid, 22 parts of anhydrous trimellitic acid and 2 parts of dibutyl tin oxide and reaction was performed at an ordinary pressure at 230° C. for 8 hours. Then the reaction was performed under reduced pressure of 10 mmHg to 15 mmHg for 5 hours to synthesize an intermediate polyester resin.

The obtained intermediate polyester resin had a number average molecular mass of 2,100, a mass average molecular mass of 9,500, a glass transition temperature of 55° C. and an acid value of 0.5 mgKOH/g and a hydroxyl value of 51 mgKOH/g.

Then, a reaction vessel with a condenser, a stirrer and the nitrogen introduction pipe was charged with 410 parts of the intermediate polyesters, 89 parts of isophorone diisocyanate and 500 parts of ethyl acetate and the reaction was performed at 100° C. for 5 hours to synthesize a prepolymer. The free radical isocyanate content of the obtained prepolymer was 1.53% by mass.

A reaction vessel with a stirring bar and a thermometer was charged with 170 parts of isophorone diamine and 75 parts of methyl ethyl ketone and the reaction was performed at 50° C. for 5 hours to synthesize a ketimine compound. The amine value of the obtained ketimine compound was 418 mgKOH/g.

749 parts of the dispersion of toner materials, 115 parts of the prepolymer and 2.9 parts of the ketimine compound were charged in a reaction vessel and mixed using TK HOMOMIXER (manufactured by Primix Corporation) and mixed at 5, 000 rpm for one minute to obtain an oil phase mixture.

683 parts of water, 11 parts of a reactive emulsifier (sodium salt of sulfuric acid ester of methacrylic acid ethylene oxide adduct) ELEMINOL RS-30 (manufactured by Sanyo Chemical Industries Corporation), 83 parts of styrene, 83 parts of methacrylic acid, 110 parts of butyl acrylate and 1 part of ammonium persulfate were charged in a reaction vessel with a stirring bar and a thermometer, stirred at 400 rpm for 15 minutes to obtain an emulsion. The emulsion was heated up to 75° C. and reacted for 5 hours. Then, 30 parts of 1% ammonium persulfate aqueous solution were added and matured at 75° C. for 5 hours to prepare a resin particle dispersion.

990 parts of water, 83 parts of the resin particle dispersion, 37 parts of 48.5% aqueous solution of the dodecyl diphenyl ether sodium disulphonate, ELEMINOL MON-7 (produced by Sanyo Chemical Industries Corporation), 135 parts of 1% aqueous solution of a polymer dispersant sodium carboxymethylcellulose, CELLOGENE BS-H-3 (produced by Dai-ichi Kogyo Seiyaku Corporation) and 90 parts of ethyl acetate were mixed and stirred to obtain an aqueous medium. 867 parts of the oil phase mixture were added to 1,200 parts of the aqueous medium and mixed using TK HOMOMIXER at 13, 000 rpm for 20 minutes to prepare a dispersion (emulsified slurry).

Then, the emulsified slurry was charged in reaction vessel with a stirrer and a thermometer, removed of the solvents at 30° C. for 8 hours and subsequently matured at 45° C. for four hours to obtain a dispersion slurry.

The volume average particle diameter (Dv) and the number average particle diameter (Dn) of the toner were measured with a particle size measuring instrument ("MULTISIZER III" manufactured by Beckman Coulter Corporation) at an aperture diameter of 100 μm and analyzed by analysis software (Beckman Coulter Mutlisizer 3 Version 3.51). Specifically, 0.5 ml of 10% surfactant (alkylbenzenesuphonate salt neogen SC-A produced by Dai-ichi Kogyo Seiyaku Corporation) were added to a 100 ml glass beaker and each 0.5 g of the toner was added and stirred with a micro-spatula and subsequently 80 ml of ion-exchanged water was added thereto. The obtained dispersion was subjected to dispersion treatment with a supersonic wave distributor (W-113MK-II manufactured by Honda Electronics Co., Ltd.) for ten minutes. The dispersion was measured with the above-mentioned MULTI-SIZER III using ISOTON III (manufactured by Beckman Coulter) as a solution for measurement. The measurement was performed by adding dropwise the above toner sample dispersion so that the concentration shown by the apparatus became 8±2%. It is important to adjust the concentration as mentioned above to 8±2% from a viewpoint of measurement reproducibility of the particle size.

Errors do not occur in the particle size within this concentration range.

After 100 parts of the dispersion slurry was filtered under reduced pressure, 100 parts of ion-exchanged water were added to the filter, mixed using TK HOMOMIXER at 12, 000 rpm for ten minutes and then filtered.

To the obtained filter cake was added 10% hydrochloric acid, pH was adjusted to 2.8, mixed using TK HOMOMIXER at 12, 000 rpm for ten minutes and then filtered.

Furthermore, an operation of adding 300 parts of ion-exchanged water to the obtained filter cake, mixing them using TK HOMOMIXER at 12, 000 rpm for ten minutes and then filtering was performed twice to obtain the final filter cake.

The obtained final filter cake was dried at 45° C. with an air circulating drier for 48 hours and sieved through mesh with an opening of 75 μm to obtain toner base particles.

To 100 parts of the obtained toner base particles, were added 1.0 part of hydrophobic silica and 0.5 part of hydrophobized titanium oxide as external additives, and the resulted particles were subjected to mixing treatment using a Henschel mixer (manufactured by Mitsui Mining Corporation) to produce Toner 1.

Example 2

Toner 2 was produced in the same manner as in Example 1 except that Pigment dispersant A was changed to Pigment dispersant B.

Example 3

Toner 3 was produced in the same manner as in Example 1 except that Pigment dispersant A was changed to Pigment dispersant C.

Example 4

Toner 4 was produced in the same manner as in Example 1 except that Pigment dispersant A was changed to Pigment dispersant D.

Example 5

Toner 5 was produced in the same manner as in Example 1 except that Non-modified Polyester A was changed to Non-modified Polyester B.

Example 6

Toner 6 was produced in the same manner as in Example 5 except that Pigment dispersant A was changed to Pigment dispersant B.

Example 7

Toner 7 was produced in the same manner as in Example 5 except that Pigment dispersant A was changed to Pigment dispersant C.

Example 8

Toner 8 was produced in the same manner as in Example 5 except that Pigment dispersant A was changed to Pigment dispersant D.

Comparative Example 1

Toner 9 was produced in the same manner as in Example 1 except that Pigment dispersant A was changed to DISPARLON DA-725 (manufactured by Kusumoto Chemicals, Ltd.).

Comparative Example 2

Toner 10 was produced in the same manner as in Example 1 except that Pigment dispersant A was changed to EFKA4010 (manufactured by Kusumoto Chemicals, Ltd.).

Comparative Example 3

Toner 11 was produced in the same manner as in Example 1 except that Pigment dispersant A was changed to PB711 (manufactured by Ajinomoto Fine-Techno Co., Ltd.).

Comparative Example 4

Toner 12 was produced in the same manner as in Example 5 except that Pigment dispersant A was changed to DISPARLON DA-725 (manufactured by Kusumoto Chemicals, Ltd.).

Comparative Example 5

Toner 13 was produced in the same manner as in Example 5 except that Pigment dispersant A was changed to EFKA4010 (manufactured by Kusumoto Chemicals, Ltd.).

Comparative Example 6

Toner 14 was produced in the same manner as in Example 5 except that Pigment dispersant A was changed to PB711 (manufactured by Ajinomoto Fine-Techno Co., Ltd.).

Comparative Example 7

Toner 15 was produced in the same manner as in Example 1 except that Pigment dispersant A was changed to Pigment dispersant E.

With the combinations of the non-modified polyesters and the pigment dispersants used in the obtained Toners 1-15, the glass transition temperatures of the mixtures of a non-denatured polyester (binder resin) and a pigment dispersant in a ratio of 100:5 (mass ratio) are shown in Table 1.

Here, the glass transition temperature (Tg) was determined specifically by the following procedure. The measurement was performed with TA-60WS and DSC-60 manufactured by Shimadzu Corporation under the measurement conditions shown below.

Measurement Conditions
Sample container: Sample pan made of aluminum (with a lid)
Sample amount: 5 mg
Reference: Sample pan made of aluminum (Alumina 10 mg)
Atmosphere: Nitrogen (Flow rate 50 ml/min)
Temperature Conditions
Initial temperature: 20° C.
Temperature elevation rate: 10° C./min
Final temperature: 150° C.
Retention time: None
Temperature lowering rate: 10° C./min
Final temperature: 20° C.
Retention time: None
Temperature elevation rate: 10° C./min
Final temperature: 150° C.

The measured results were analyzed using the above-mentioned data analysis software (TA-60, version 1.52) available from Shimadzu Corporation. The method of analysis was performed by appointing a range of ±5° C. around a point showing the maximum peak of DrDSC curve on the lowest temperature side, which is the differential curve of the DSC curve in the second heating, and determining the peak temperature using a peak analysis function of the analysis software. Then, the maximum endotherm temperature of the DSC curve was determined in the range of the above peak temperature +5° C. and −5° C. in the DSC curve using a peak analysis function of the analysis software. The temperature shown here corresponded to Tm of the wax.

TABLE 1

| | | | Pigment dispersant | | | Tg of | Tg of mixture of binder resin and polymer dispersant in |
|---|---|---|---|---|---|---|---|
| | Toner No. | Binder resin | Type | Acid value [mgKOH/g | Amine value [mgKOH/g | binder resin [° C.] | ratio of 100:5 [° C.] |
| Example 1 | Toner 1 | Binder resin A | Pigment dispersant A | 31 | 25 | 44 | 42 |
| Example 2 | Toner 2 | Binder resin A | Pigment dispersant B | 44 | 28 | 44 | 43 |
| Example 3 | Toner 3 | Binder resin A | Pigment dispersant C | 33 | 4 | 44 | 41 |
| Example 4 | Toner 4 | Binder resin A | Pigment dispersant D | 48 | 45 | 44 | 44 |
| Example 5 | Toner 5 | Binder resin B | Pigment dispersant A | 31 | 25 | 61 | 52 |
| Example 6 | Toner 6 | Binder resin B | Pigment dispersant B | 44 | 28 | 61 | 54 |
| Example 7 | Toner 7 | Binder resin B | Pigment dispersant C | 33 | 4 | 61 | 58 |
| Example 8 | Toner 8 | Binder resin B | Pigment dispersant D | 36 | 45 | 61 | 53 |
| Comparative Example 1 | Toner 9 | Binder resin A | DISPARLON DA-725 | 20 | 48 | 44 | 38 |
| Comparative Example 2 | Toner 10 | Binder resin A | EFKA 4010 | 25 | 13 | 44 | 35 |
| Comparative Example 3 | Toner 11 | Binder resin A | PB 711 | 2 | 43 | 44 | 32 |
| Comparative Example 4 | Toner 12 | Binder resin B | DISPARLON DA-725 | 20 | 48 | 61 | 54 |
| Comparative Example 5 | Toner 13 | Binder resin B | EFKA 4010 | 25 | 13 | 61 | 50 |
| Comparative Example 6 | Toner 14 | Binder resin B | PB 711 | 2 | 43 | 61 | 48 |
| Comparative Example 7 | Toner 15 | Binder resin A | Pigment dispersant E | 55 | 58 | 44 | 40 |

Fixing characteristics of the toner were evaluated as follows. Evaluation was performed in the same manner as in (a) using a modified machine prepared by mounting a belt heating fixing device shown in FIG. 2 on IMAGIO NEO 450 manufactured by Ricoh Company, Ltd. Here, constitution having a base material of the belt of 100 μm polyimide, a middle elastic layer of 100 μm silicone rubber, an offset prevention on the surface which is 15 μm PFA, a fixation roller made of silicone foam, a metal cylinder of a pressurization roller made of SUS having a thickness of 1 mm, an offset prevention layer of the pressurization roller made of a PFA tube+silicone rubber having a thickness of 2 mm, a heating roller made of aluminum having a thickness of 2 mm, and a surface pressure of $1\times10^5$ Pa was used.

Evaluation standards for respective characteristics were as follows.

(1) Low temperature Fixing Properties (5-Scale Evaluation)

A: Less than 120° C.

B: 120° C. or more but less than 130° C.

C: 130° C. or more but less than 140° C.

D: 140° C. or more but less than 150° C.

E: 150° C. or more (2) Hot Offset Resistance (5-Scale Evaluation)

A: More than 201° C.

B: 200° C. to 191° C.

C: 190° C. to 181° C.

D: 180° C. to 171° C.

E: Less than 170° C.

The above-mentioned evaluation results of the toner are shown in Table 2.

(Heat-Resistant Storage Stability)

A toner was fill in a glass vessel and allowed to stand still in a constant-temperature bath at 50° C. for 24 hours. This toner was cooled to 24° C. and penetration degree was measure by the penetration degree test (JIS K2235-1991). The measurement of the penetration degree was expressed with percentage assuming that the top surface of the toner was 0 and the bottom face of the glass vessel was 100.

The higher value a toner had as this penetration degree, the more excellent the toner was in the storage stability against heat and when the needle thoroughly penetrated, this value reached 100%. When this value is less than 60%, blocking of the toner may be caused during transportation and aggregates of the toner may occur at the time of the use at a high temperature and a high humidity, and image abnormality appears.

The criteria of the heat storage stability based on the penetration degree were as follows.

A: 80% to 100%

B: 79% to 60%

C: less than 60%

(Charge Stability)

The charged amount at a low temperature at a low humidity and at a high temperature at a high humidity was measured by blow method and the variation width therebetween was evaluated. A silicone resin coated iron powder was used as a carrier, and the measurement was performed in environments at 30° C. at 90% condition and at 10° C. at 30% condition. The charge stability was evaluated from the change rate in the charged amount represented by Expression 3: $((\alpha-\beta)^2/(\alpha+\beta)^2)^{1/2}$ calculated from the saturated charged amount at 10° C. at 30% condition $\alpha$ and saturated charged amount at 30° C. at 90% condition $\beta$.

A: Less than 15

B: 15 or more but less than 30

C: 30 or more but less than 40

D: 40 or more (Color Saturation)

A solid image having an attached amount of 1.00±0.05 mg/cm$^2$ was prepared with a fixation roller with a surface temperature of 160±2° C. was printed on a copy paper (TYPE6000) <70W> manufactured by Ricoh Company, Ltd.) using IMAGIO NEO 450 manufactured by Ricoh Company, Ltd., and the color saturation (C*) of a single color solid image was measured using X-RITE938, and evaluation was performed by ranking with five scales based on the following criteria. Here, the higher the color saturation means that the color is less clouded and brilliant.

A: 76 or more

B: 72 or more but less than 76

C: 64 or more but less than 72

D: Less than 64

Evaluation results of the toner are shown in Table 2.

TABLE 2

| | Toner No. | Color saturation | Charging characteristics | Fixing characteristics Lower limit | Fixing characteristics Hot Offset | Heat-resistant storage stability |
|---|---|---|---|---|---|---|
| Example 1 | Toner 1 | B | A | A | A | B |
| Example 2 | Toner 2 | A | A | A | A | B |
| Example 3 | Toner 3 | B | A | A | A | B |
| Example 4 | Toner 4 | A | A | A | A | B |
| Example 5 | Toner 5 | B | A | A | A | A |
| Example 6 | Toner 6 | A | A | A | A | A |
| Example 7 | Toner 7 | B | A | A | A | A |
| Example 8 | Toner 8 | A | A | A | A | A |
| Comparative Example 1 | Toner 9 | D | C | A | D | C |
| Comparative Example 2 | Toner 10 | C | B | A | D | C |
| Comparative Example 3 | Toner 11 | D | B | E | D | C |
| Comparative Example 4 | Toner 12 | D | C | A | B | B |
| Comparative Example 5 | Toner 13 | D | B | A | A | B |
| Comparative Example 6 | Toner 14 | D | B | E | A | C |
| Comparative Example 7 | Toner 15 | B | D | A | E | C |

It can be understood from these results that the toner of the examples is excellent in color saturation, charge characteristic, fixing characteristics and heat-resistant storage stability. In contrast, deterioration in color saturation is observed in the toner of Comparative Example 1 since the toner has a low acid value and insufficient pigment dispersibility. In addition, associated with poor dispersion of pigment, and associated with inhomogeneity of the toner particles, deterioration in hot offset resistance, heat resistant storage stability are observed.

Color saturation of the toner is good in the toner of Comparative Example 7 since this toner has a high acid value and a high amine value. However, deterioration in the charging characteristics associated with the high amine value and further hot offset resistance and deterioration in the heat resistant storage stability associated with the high acid value are observed.

What is claimed is:

1. A toner for image formation granulated by dispersing, emulsifying, or both dispersing and emulsifying an oil phase containing toner constituting materials in an aqueous medium, the toner constituting materials comprising:

a binder resin comprising a polyester resin;

a colorant; and a pigment dispersant which is a polyester derivative having an acid value ranging from 28 mgKOH/g to 50 mgKOH/g, and an amine value ranging from 1 mgKOH/g to 50 mgKOH/g, wherein the toner constituting materials satisfy the following Expressions 1 and 2:

Binder resin:Pigment dispersant=100:5 Expression 1

$0° C. \leqq \alpha - \beta \leqq 10° C.$ Expression 2 where Expression 1 represents a mass ratio, $\alpha$ is a glass transition temperature of the binder resin, and $\beta$ is a glass transition temperature of a mixture of the binder resin and the pigment dispersant in the ratio of Expression 1.

2. The toner according to claim 1, wherein the glass transition temperature of the binder resin ranges from 40° C. to 65° C.

3. The toner according to claim 1, wherein a melting of the pigment dispersant ranges from 20° C. to 80° C.

4. The toner according to claim 1, wherein the pigment dispersant is contained in the toner in a ratio ranging 0.1% by mass to 5% by mass.

5. The toner according to claim 1, wherein the oil phase comprises a precursor of the binder resin included in the toner constituting material.

6. The toner according to claim 1, wherein the toner has a ratio of a volume average particle size thereof to a number average particle size thereof ranging from 1.00 to 1.25.

7. A method for producing a toner for image formation, comprising:

dispersing, emulsifying, or both dispersing and emulsifying an oil phase comprising toner constituting materials in an aqueous medium so as to granulate the toner, wherein the toner constituting material comprises:

a binder resin comprising a polyester resin;

a colorant; and a pigment dispersant which is a polyester derivative having an acid value ranging from 28 mgKOH/g to 50 mgKOH/g, and an amine value ranging from 1 mgKOH/g to 50 mgKOH/g, wherein the toner constituting materials satisfy the following Expressions 1 and 2:

Binder resin:Pigment dispersant=100:5 Expression 1

$0° C. \leqq \alpha - \beta \leqq 10° C.$ Expression 2 where Expression 1 represents a mass ratio, $\alpha$ is a glass transition temperature of the binder resin, and $\beta$ is a glass transition temperature of a mixture of the binder resin and the pigment dispersant in the ratio of Expression 1, and wherein the oil phase further comprises a solvent in which the toner constituting materials are dissolved or dispersed.

8. The method according to claim 7, wherein the solvent comprises an organic solvent, and the method further comprises removing the organic solvent.

* * * * *